US007482544B2

(12) United States Patent
Gong et al.

(10) Patent No.: US 7,482,544 B2
(45) Date of Patent: Jan. 27, 2009

(54) LIFT CHAIR AND A CHAIR BASE FRAME WITH AN ACTUATOR FOR USE THEREWITH

(75) Inventors: Jiaxiong Gong, Changzhou (CN); Ming Yin, Changzhou (CN); Xiaojun Gong, Changzhou (CN); Quan Liu, Ames, IA (US); Xiaoxiang Zhang, La Palma, CA (US); Yongyong Mao, Shanghai (CN)

(73) Assignee: I-Trust Better Life Corp., Buena Park, CA (US)

( * ) Notice: Subject to any disclaimer, the term of this patent is extended or adjusted under 35 U.S.C. 154(b) by 202 days.

(21) Appl. No.: 11/648,232

(22) Filed: Dec. 29, 2006

(65) Prior Publication Data

US 2008/0000761 A1 Jan. 3, 2008

(30) Foreign Application Priority Data

Jun. 30, 2006 (CN) ..... 2006 3 0088570
Jul. 7, 2006 (CN) ..... 2006 3 0122026

(51) Int. Cl.
*H01H 9/00* (2006.01)

(52) U.S. Cl. ..... 200/47; 200/1 V; 297/330

(58) Field of Classification Search ..... 200/1 V, 200/47; 297/330; 318/111–116
See application file for complete search history.

(56) References Cited

U.S. PATENT DOCUMENTS 2,920,684 A 1/1960 Fante et al.
4,077,483 A 3/1978 Randolph
4,434,468 A 2/1984 Caddick et al.
4,909,569 A 3/1990 Gaffney
5,556,163 A 9/1996 Rogers, III et al.
5,901,610 A 5/1999 Schneider
5,918,505 A 7/1999 Jensen
6,000,758 A 12/1999 Schaffner et al.
6,377,010 B1 4/2002 Roither
6,629,731 B2 10/2003 Rogers et al.

(Continued)

*Primary Examiner*—Michael A Friedhofer
*Assistant Examiner*—Lisa N Klaus
(74) *Attorney, Agent, or Firm*—Morris Manning Martin LLP; Tim Tingkang Xia, Esq.

(57) ABSTRACT

An actuator usable in a support frame for use in a lift chair. In one embodiment, the actuator has a housing, a reversible electric motor positioned in the housing, a worm that connects with a worm wheel, wherein the worm is driven by the electric reversible motor in operation, an outer tube member that extends through an opening defined in a front end of the housing and has a central axis, an activation rod configured to be telescopically movable relative to the outer tube member, a first pushing member movable with the activation rod and having a threaded opening, a first protrusion member and a second protrusion member spaced apart from the first protrusion member, a first push button switch with a push button, and a second push button switch with a push button, the first push button switch and second push button switch electrically coupled to the electric reversible motor and positioned apart in the housing such that when, during operation, the motion of the activation rod relative to the outer tube member causes the first pushing member to move along with a direction parallel to the central axis, the first protrusion member engages with or disengages from the push button of the first push button switch to cause the first push button switch to be in a first state or in a second state.

48 Claims, 15 Drawing Sheets

U.S. PATENT DOCUMENTS 6,880,416 B2 4/2005 Koch
7,047,834 B2 5/2006 Nielsen et al.
7,066,041 B2 6/2006 Nielsen
7,090,297 B2 8/2006 Mohn et al.
7,137,489 B2 11/2006 Bastholm et al.

A-A

A

LIFT CHAIR AND A CHAIR BASE FRAME WITH AN ACTUATOR FOR USE THEREWITH

CROSS-REFERENCE TO RELATED PATENT APPLICATION

This application claims priority of Chinese Patent Application Nos. 200630122026.X, filed on Jul. 7, 2006, entitled "A CHAIR BASE FRAME" by Jiaxiong Gong, Ming Yin, and Xiaojun Gong, and 200630088570.7, filed on Jun. 30, 2006, entitled "A LINEARLY DRIVEN DEVICE" by Jiaxiong Gong, Ming Yin, and Xiaojun Gong, the disclosures of which are incorporated herein by reference in their entireties.

Some references, which may include patents, patent applications and various publications, are cited in a reference list and discussed in the description of this invention. The citation and/or discussion of such references is provided merely to clarify the description of the present invention and is not an admission that any such reference is "currently available" to the invention described herein. All references cited and discussed in this specification are incorporated herein by reference in their entireties and to the same extent as if each reference was individually incorporated by reference.

FIELD OF THE INVENTION

The present invention generally relates to a chair base frame for use with a power driven reclining lift chair, and in particular to a chair base frame with an improved actuator.

BACKGROUND OF THE INVENTION

Lift chairs find widespread use in elderly, disabled and/or infirm persons. In reclining chairs a tiltable back and seat are driven between an erect and a reclined position, and a leg or foot rest is driven between a retracted and an extended position. A lift chair is powered between a normal seat position and an elevated forwardly inclined position by an actuator. As partially shown in FIGS. 12A and 12B, a currently available actuator 1200 has a two-piece housing 1201, a motor 1202 inside a housing part 1201*a*, a spindle 1204 with a spindle nut, an extendible shaft portion or activation rod 1206, an outer tube 1207 and a rear mounting 1208. Inside the tube 1207, there is an elongated print-board 1248, which has a first signal switch 1249*a* at a first end and a second signal switch 1249*b* at an opposite, second end, which are activated by a corresponding spring arm 1250A, 1250B fitted on a seat in connection with one of the first signal switch 1249*a* and the second signal switch 1249*b*. When the spindle nut reaches an end position, it will press one of the spring arm 1250A, 1250B against a corresponding one of the first signal switch 1249*a* and the second signal switch 1249*b*, which is then activated and via the control stops the motor 1202. The distance between the first signal switch 1249*a* and the second signal switch 1249*b* determines a range for the movement of the extendible shaft portion or activation rod 1206, which is corresponding to a range of positions between a normal seat position and an elevated forwardly inclined position and needs to be precisely controllable for better use by, say, an occupant of a lift chair using the actuator. However, because inherent errors built in when the first signal switch 1249*a* and the second signal switch 1249*b* in connection with the print-board 1248 are installed, it may be difficult to achieve a desired precise control of the range of positions. Moreover, because the first signal switch 1249*a* and the second signal switch 1249*b* in connection with the print-board 1248 are installed inside the tube 1207 with the movable spindle 1204 and the extendible shaft portion or activation rod 1206, additional wirings need to be in place, which are nevertheless subject to the disturbance caused by frequent movements of the movable spindle 1204 and the extendible shaft portion or activation rod 1206 and may be easily damaged. Damaged wiring may cause safety hazard.

Therefore, a heretofore unaddressed need exists in the art to address the aforementioned deficiencies and inadequacies.

SUMMARY OF THE INVENTION

The present invention, in one aspect, relates to an actuator that is usable in a support frame for use in a lift chair. In one embodiment, the actuator has a housing having a first housing part and a second housing part, the housing defining a front end and a rear end;

the first housing part configured to define an opening on a side and provide a journal bearing;

a reversible electric motor positioned in the first housing part and received by the opening;

a worm that extends into the journal bearing and connects with a worm wheel, wherein the worm is driven by the electric reversible motor in operation;

an outer tube member that extends through an opening defined in the front end of the housing to a free end spaced forwardly of the front end of the housing and has a central axis;

an activation rod that extends from within the housing through and beyond the free end of the outer tube member to an opposite, second end providing a first fitting for connection to a first pushing member, the activation rod being telescopically movable relative to the outer tube member;

the first pushing member movable with the activation rod and having a threaded opening, a first protrusion member and a second protrusion member spaced apart from the first protrusion member;

a spindle bearing supported by a corresponding spindle bearing recess formed in the housing proximate to the rear end of the housing;

a spindle that is mounted in the spindle bearing and extends into the threaded opening of the activation rod for connection to the activation rod, rotation of the worm and the worm wheel by the electric reversible motor causing the spindle to rotate and telescopically move the activation rod relative to the outer tube member; and a first push button switch with a push button and a second push button switch with a push button, the first push button switch and second push button switch electrically coupled to the electric reversible motor and positioned apart in the housing;

wherein the first push button switch and second push button switch are positioned in the housing and the first protrusion member and second protrusion member of the first pushing member are configured such that when, during operation, the motion of the activation rod relative to the outer tube member causes the first pushing member to move along a direction parallel to the central axis, the first protrusion member engages with or disengages from the push button of the first push button switch to cause the first push button switch to be in a first state or in a second state that is different from the first state, respectively.

The actuator further has a cover member fixedly connected to the free end of the outer tube member and defining an opening in communication with the opening of the outer tube member to allow the activation rod to be movable relative to the outer tube member.

The actuator further has a second pushing member slidably received in a corresponding recess formed in the inner surface of the outer tube member, the second pushing member having a first end, an opposite, second end and a recess formed at least partially from the first end to the second end, wherein the recess is configured to be slidably engageable with the second protrusion member of the first pushing member so that the second pushing member slidably engages with the second protrusion member of the first pushing member.

One of the first push button switch and the second push button switch is an always-on push button switch and the other is an always-off push button switch.

In one embodiment, the first push button switch is an always-on push button switch, and the second push button switch is an always-off push button switch.

The first state is an off state, and the second state is an on state.

In one embodiment, the second pushing member is positioned and configured such that when the first protrusion member engages with the push button of the first push button switch to cause the first push button switch to be in an off state, the first end of the second pushing member engages with the push button of the second push button switch to cause the second push button switch to be in an on state.

The second pushing member is positioned and configured such that when, during operation, the motion of the activation rod relative-to the outer tube member causes the first pushing member to move along with a direction parallel to the central axis, the first protrusion member disengages from the push button of the first push button switch to cause the first push button switch to be in an on state, the first end of the second pushing member disengages from the push button of the second push button switch to cause the second push button switch to be in an off state. Furthermore, when the first push button switch is in an on state, the second push button switch is also in an on state if the first end of the second pushing member still engages with the push button of the second push button switch to cause the second push button switch to be in an off state.

The actuator further comprises a first diode electrically coupled to the first push button switch in parallel and having an anode and a cathode, and a second diode electrically coupled to the second push button switch in parallel and having an anode and a cathode, wherein the first diode and the second diode are electrically coupled in a configuration such that the cathode of the first diode is electrically coupled to the cathode of the second diode.

The actuator further comprises a resilient member positioned between the cover member and the second end of the second pushing member for providing a force against the second end. The resilient member in one embodiment comprises a spring.

In another aspect, the present invention relates to an actuator that is usable in a support frame for use in a lift chair. In one embodiment, the actuator comprises:

a housing;

a reversible electric motor positioned in the housing;

a worm that connects with a worm wheel, wherein the worm is driven by the electric reversible motor in operation;

an outer tube member that extends through an opening defined in a front end of the housing and has a central axis;

an activation rod configured to be telescopically movable relative to the outer tube member;

a first pushing member movable with the activation rod and having a threaded opening, a first protrusion member and a second protrusion member spaced apart from the first protrusion member;

a first push button switch with a push button; and a second push button switch with a push button, the first push button switch and second push button switch electrically coupled to the electric reversible motor and positioned apart in the housing.

In one embodiment, the first push button switch and second push button switch are positioned in the housing and the first protrusion member and second protrusion member of the first pushing member are configured such that when, during operation, the motion of the activation rod relative to the outer tube member causes the first pushing member to move along a direction parallel to the central axis, the first protrusion member engages with or disengages from the push button of the first push button switch to cause the first push button switch to be in a first state or in a second state that is different from the first state, respectively.

The actuator further comprises a cover member fixedly connected to the free end of the outer tube member and defining an opening to allow the activation rod to be movable relative to the outer tube member.

The actuator further comprises a second pushing member slidably received in a corresponding recess formed in the inner surface of the outer tube member, the second pushing member having a first end, an opposite, second end and a recess formed at least partially from the first end to the second end, wherein the recess is configured to be slidably engageable with the second protrusion member of the first pushing member so that the second pushing member slidably engages with the second protrusion member of the first pushing member.

One of the first push button switch and the second push button switch is an always-on push button switch and the other is an always-off push button switch.

In one embodiment, the first push button switch is an always-on push button switch, and the second push button switch is an always-off push button switch.

The first state is an off state, and the second state is an on state.

In one embodiment, the second pushing member is positioned and configured such that when the first protrusion member engages with the push button of the first push button switch to cause the first push button switch to be in an off state, the first end of the second pushing member engages with the push button of the second push button switch to cause the second push button switch to be in an on state.

The second pushing member is positioned and configured such that when, during operation, the motion of the activation rod relative to the outer tube member causes the first pushing member to move along a direction parallel to the central axis, the first protrusion member disengages from the push button of the first push button switch to cause the first push button switch to be in an on state, the first end of the second pushing member disengages from the push button of the second push button switch to cause the second push button switch to be in an off state.

Furthermore, when the first push button switch is in an on state, the second push button switch is also in an on state if the first end of the second pushing member still engages with the push button of the second push button switch to cause the second push button switch to be in an off state.

The actuator further comprises a first diode electrically coupled to the first push button switch in parallel and having an anode and a cathode, and a second diode electrically coupled to the second push button switch in parallel and having an anode and a cathode, wherein the first diode and the second diode are electrically coupled in a configuration such that the cathode of the first diode is electrically coupled to the cathode of the second diode and the anode of the second diode is electrically coupled to a first terminal of the motor.

The actuator further comprises a DC power supply having a first output terminal and a second output terminal, wherein the first output terminal of the DC power supply is electrically coupled to the anode of the first diode and the second output terminal of the DC power supply is electrically coupled to a second terminal of the motor.

The DC power supply may comprise a battery, a transformer that transforms an AC current to a DC current, or both.

The actuator further comprises a resilient member positioned between the cover member and the second end of the second pushing member for providing a force against the second end.

In a further aspect, the present invention relates to a support frame for use in a lift chair. In one embodiment, the support frame comprises:

a base frame having longitudinally extending front and rear frame base rails;

a first longitudinally extending side frame base rail connected to the front and rear frame base rails and a second longitudinally extending side frame base rail connected to the front and rear frame base rails, respectively, the first and second side frame base rails and the front and rear frame base rails being co-planar for supporting the lift chair on a surface;

an actuator, the actuator comprising:

(i). a housing;

(ii). a reversible electric motor positioned in the housing;

(iii). a worm that connects with a worm wheel, wherein the worm is driven by the electric reversible motor in operation;

(iv). an outer tube member that extends through an opening defined in a front end of the housing and has a central axis;

(v). an activation rod configured to be telescopically movable relative to the outer tube member;

a first pushing member movable with the activation rod and having a threaded opening, a first protrusion member and a second protrusion member spaced apart from the first protrusion member; and (vii). a first push button switch with a push button; and a second push button switch with a push button, the first push button switch and second push button switch electrically coupled to the electric reversible motor and positioned apart in the housing; and a support member configured to engage with the actuator and mounted to the rear frame base rail.

The first push button switch and second push button switch are positioned in the housing and the first protrusion member and second protrusion member of the first pushing member are configured such that when, during operation, the motion of the activation rod relative to the outer tube member causes the first pushing member to move along a direction parallel to the central axis, the first protrusion member engages with or disengages from the push button of the first push button switch to cause the first push button switch to be in a first state or in a second state that is different from the first state, respectively.

The actuator used in the support frame further comprises a cover member fixedly connected to the free end of the outer tube member and defining an opening to allow the activation rod to be movable relative to the outer tube member.

The actuator used in the support frame further comprises a second pushing member slidably received in a corresponding recess formed in the inner surface of the outer tube member, the second pushing member having a first end, an opposite, second end and a recess formed at least partially from the first end to the second end, wherein the is configured to be slidably engageable with the second protrusion member of the first pushing member so that the second pushing member slidably engages with the second protrusion member of the first pushing member.

One of the first push button switch and the second push button switch is an always-on push button switch and the other is an always-on push button switch.

In one embodiment, the first push button switch is an always-off push button switch, and the second push button switch is an always-off push button switch.

The first state is an off state, and the second state is an on state.

The second pushing member is positioned and configured such that when the first protrusion member engages with the push button of the first push button switch to cause the first push button switch to be in an off state, the first end of the second pushing member engages with the push button of the second push button switch to cause the second push button switch to be in an on state.

The second pushing member is positioned and configured such that when, during operation, the motion of the activation rod relative to the outer tube member causes the first pushing member to move along a direction parallel to the central axis, the first protrusion member disengages from the push button of the first push button switch to cause the first push button switch to be in an on state, the first end of the second pushing member disengages from the push button of the second push button switch to cause the second push button switch to be in an off state.

Furthermore, when the first push button switch is in an on state, the second push button switch is also in an on state if the first end of the second pushing member still engages with the push button of the second push button switch to cause the second push button switch to be in an off state.

The actuator used in the support frame further comprises a first diode electrically coupled to the first push button switch in parallel and having an anode and a cathode, and a second diode electrically coupled to the second push button switch in parallel and having an anode and a cathode, wherein the first diode and the second diode are electrically coupled in a configuration such that the cathode of the first diode is electrically coupled to the cathode of the second diode and the anode of the second diode is electrically coupled to a first terminal of the motor.

The actuator used in the support frame further comprises a DC power supply having a first output terminal and a second output terminal, wherein the first output terminal of the DC power supply is electrically coupled to the anode of the first diode and the second output terminal of the DC power supply is electrically coupled to a second terminal of the motor.

The actuator used in the support frame further comprises an engagement member that is fixedly connected with the housing and protruding away from the rear end to engage with the support member.

A lift chair can be constructed with such a support frame.

In yet a further aspect, the present invention relates to an actuator that is usable in a support frame for use in a lift chair. In one embodiment, the actuator comprises:

a reversible electric motor having a first terminal and a second terminal;

a first push button switch having a push button, a first terminal and a second terminal;

a second push button switch having a push button, a first terminal and a second terminal, wherein the first terminal of the second push button switch is electrically coupled to the second terminal of the first push button switch;

a first diode having an anode and a cathode; and a second diode having an anode and a cathode, wherein the first diode is electrically coupled to the first push button switch in parallel with the anode of the first diode electrically coupled to the first terminal of the first push button switch and the cathode of the first diode electrically coupled to the second terminal of the first push button switch, respectively;.

wherein the second diode is electrically coupled to the second push button switch in parallel with the cathode of the second diode electrically coupled to the first terminal of the second push button switch and the anode of the second diode electrically coupled to the second terminal of the second push button switch, respectively;

wherein the anode of the second diode and the second terminal of the second push button switch are electrically coupled to the first terminal of the electric reversible motor;

wherein the anode of the first diode and the first terminal of the first push button switch are electrically couple to a first power terminal; and wherein the first terminal of the electric reversible motor is electrically coupled to a second power terminal.

The actuator further comprises a DC power supply having a first output terminal and a second output terminal, wherein the first output terminal of the DC power supply is electrically coupled to the first power terminal and the second output terminal of the DC power supply is electrically coupled to the second power terminal.

When the first push button switch is in an off state and the second push button switch is in an on state, the motor can only rotate in a first direction.

When the first push button switch is in an on state and the second push button switch is in an off state, the motor can only rotate in a second direction that is opposite to the first direction.

When the first push button switch is in an on state and the second push button switch is in an on state, the motor can rotate in either of the second direction and the first direction.

A support frame utilizing such an actuator for use in a lift chair can be constructed by people who skilled in the art. A lift chair utilizing such a support frame can be constructed by people who skilled in the art.

These and other aspects of the present invention will become apparent from the following description of the preferred embodiment taken in conjunction with the following drawings, although variations and modifications therein may be affected without departing from the spirit and scope of the novel concepts of the disclosure.

DETAILED DESCRIPTION OF THE INVENTION

Figure 1:
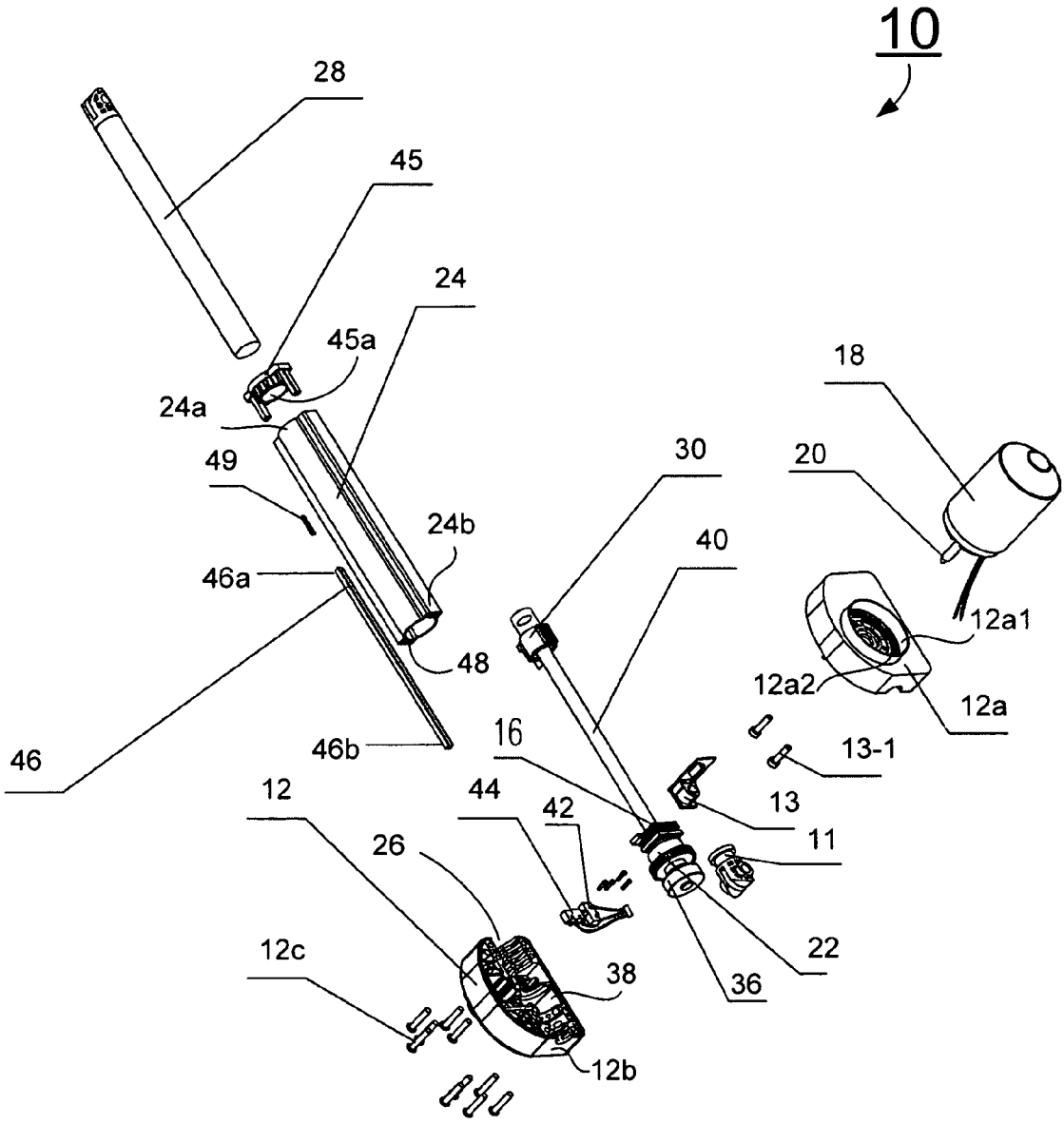
FIG. 1 schematically shows an exploded view of an actuator according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of"a", "an", and "the" includes plural reference unless the context clearly dictates otherwise. Also, as used in the description herein and throughout the claims that follow, the meaning of "in" includes "in" and "on" unless the context clearly dictates otherwise.

Figure 2:
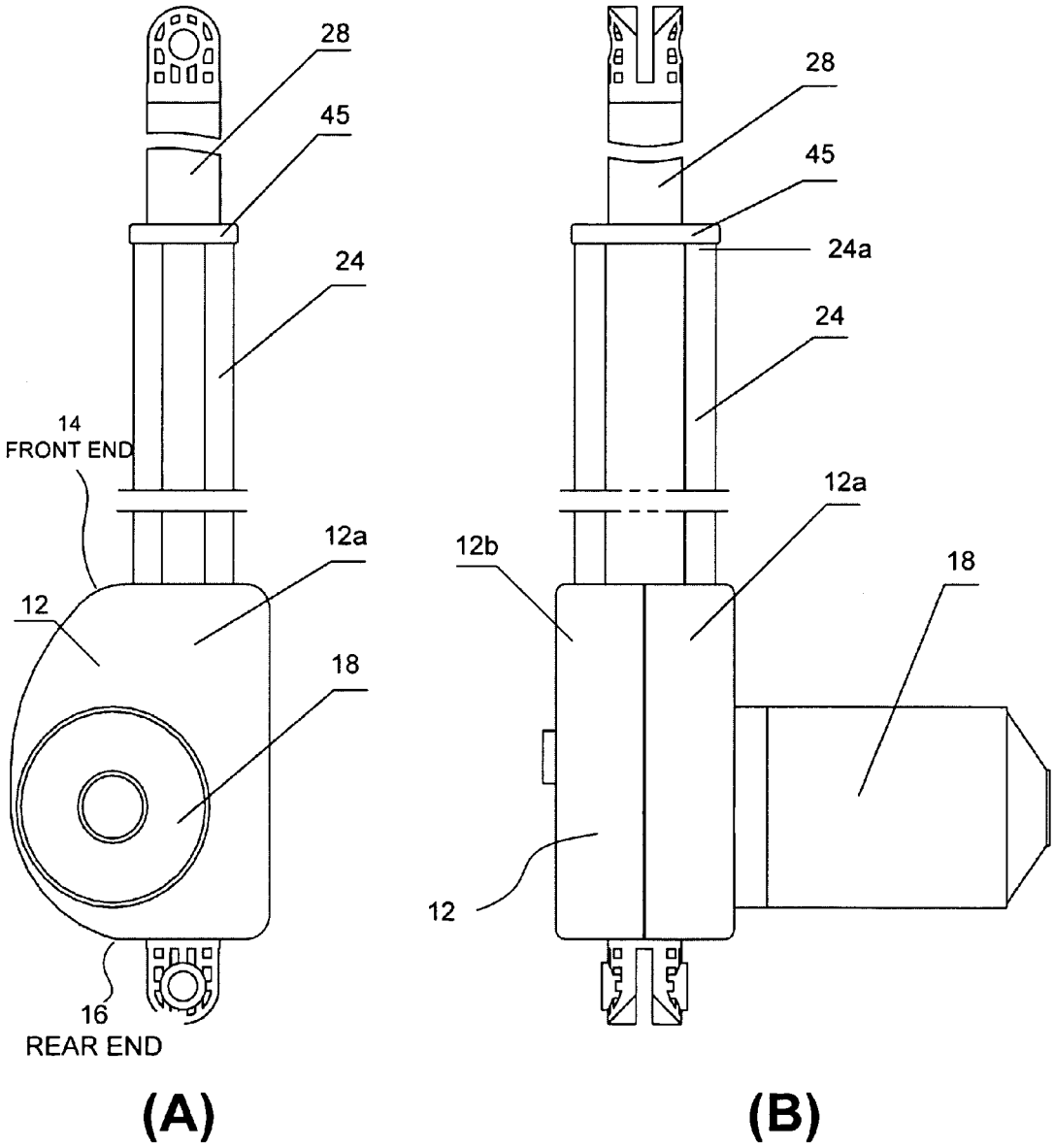
FIG. 2A schematically shows a side view of an actuator and FIG. 2B shows a top view of the actuator according to one embodiment of the present invention.
Figure 3:
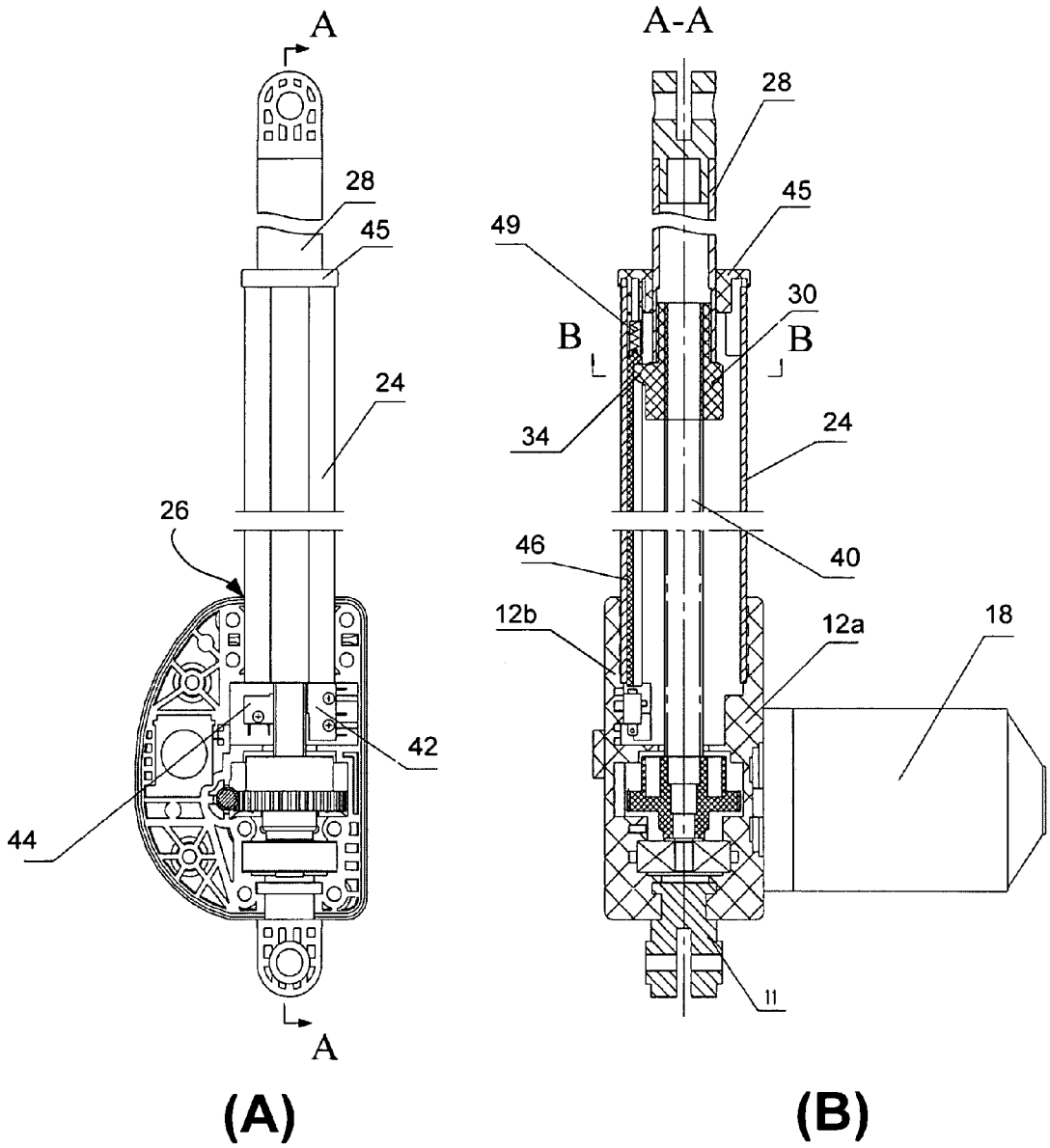
FIG. 3A schematically shows a partially sectional view of an actuator showing two push button switches 42, 44
FIG. 3B shows a sectional view of the actuator along the A-A plane as shown in FIG. 3A according to one embodiment of the present invention.

The description will be made as to the embodiments of the present invention in conjunction with the accompanying drawings FIGS. 1-11. In accordance with the aspects of this invention, as embodied and broadly described herein, this invention, in one aspect, relates to an actuator 10 that is usable in a support frame for use in a lift chair. An exploded view of an actuator 10 is shown in FIG. 1 according to one embodiment of the present invention. The actuator 10, as shown in FIGS. 1 and 2, has:

(a) a housing 12;
(b) a reversible electric motor 18;
(c) a worm 20;
(d) an outer tube member 24;
(e) an activation rod 28;
(f) a first pushing member 30;
(g) a spindle 40;
(h) a spindle bearing 36;
(i) a first push button switch 42, and
(j) a second push button switch 44.

The housing 12 has a first housing part 12*a* and a second housing part 12*b*. The first housing part 12*a* and the second housing part 12*b* are assembled by a plurality of housing screws 12*c* to form the housing 12. The housing 12 defines a front end 14 and a rear end 16. The first housing part 12*a* is configured to define an opening 12*a*1 on a side and provide a journal bearing 12*a*2. The reversible electric motor 18 is positioned in the first housing part 12*a* and received by the opening 12*a*1. The worm 20 extends into the journal bearing 12*a*2 and connects with a worm wheel 22. The worm 20 is driven by the reversible electric motor 18 in operation.

The actuator 10 further has a power supply board 13 with two contact points 13-1 for connecting power supply to the reversible electric motor 18, an engaging member 11 at the rear end 16 of the housing 12 for engaging a support frame, and a position limiting member 16 near the worm wheel 22 for stopping the first pushing member 30 from moving beyond a predetermined position.

Figure 5:
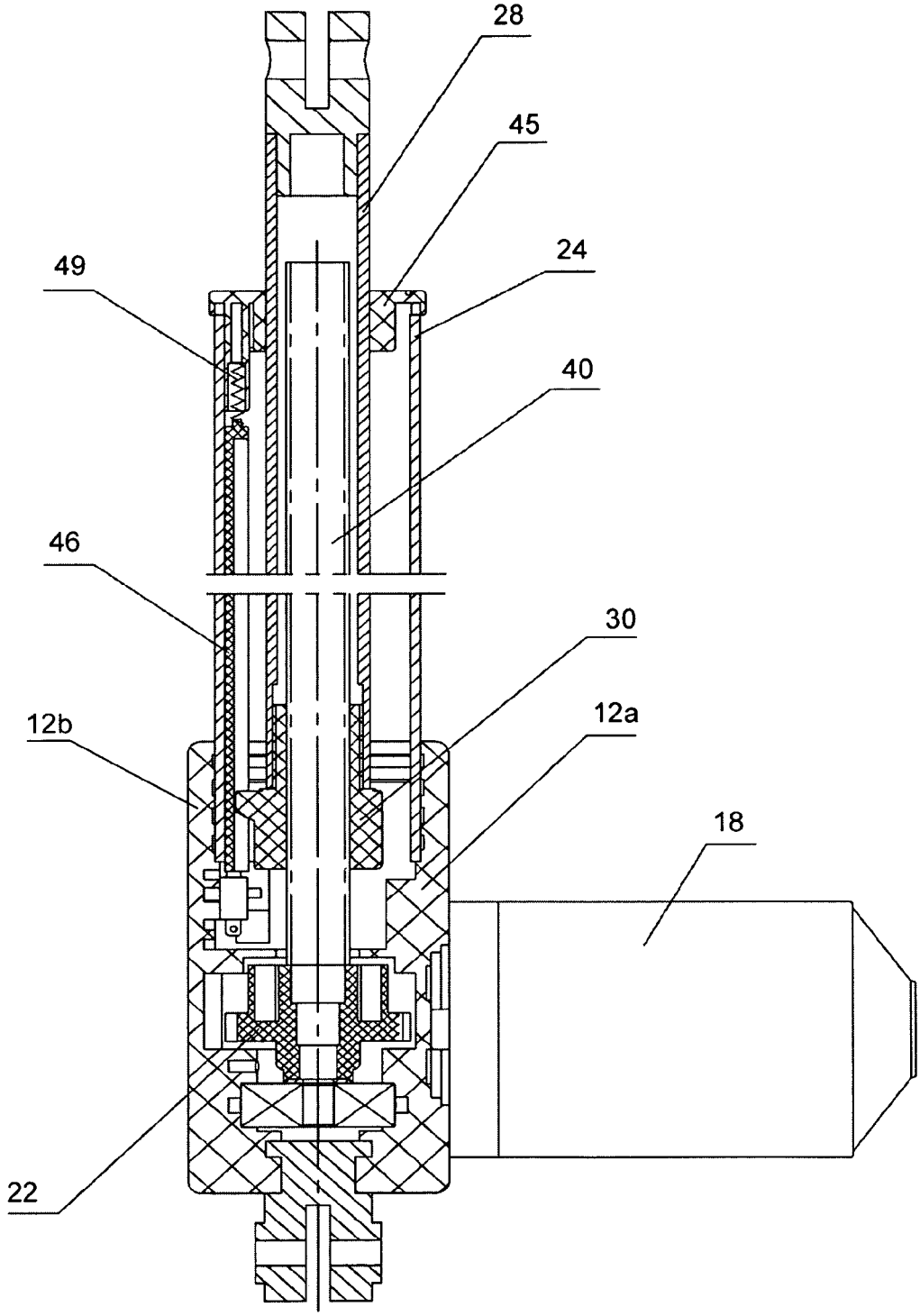
FIG. 5 schematically shows a sectional view of the actuator along the A-A plane as shown in FIG. 3A according to one embodiment of the present invention.

The outer tube member 24 extends through an opening 26 defined in the front end 14 of the housing 12 to a free end 24*a* spaced forwardly of the front end 14 of the housing 12 and has a central axis A, as shown in FIG. 5. The activation rod 28 extends from within the housing 12 through and beyond the free end 24*a* of the outer tube member 24 to an opposite, second end 24*b* providing a first fitting for connection to the first pushing member 30. The activation rod 28 is telescopically movable relative to the outer tube member 24. The first pushing member 30 is movable along with the central axis A accordingly as the activation rod 28 moves. The first pushing member 30 has a threaded opening 31, a first protrusion member 32 and a second protrusion member 34 spaced apart from the first protrusion member 32 on the outer surface of the first pushing member 30.

The spindle bearing 36 is supported by a corresponding spindle bearing recess 38 formed in the second housing part 12*b* proximate to the rear end 16 of the housing 12. The spindle 40 is mounted in the spindle bearing 36 and extends into the threaded opening 31 of the first pushing member 30 for connection to the activation rod 28. The rotation of the worm 20 and the worm wheel 22 by the reversible electric motor 18 causes the spindle 40 to rotate and telescopically move the activation rod 28 relative to the outer tube member 24.

Figure 6B:
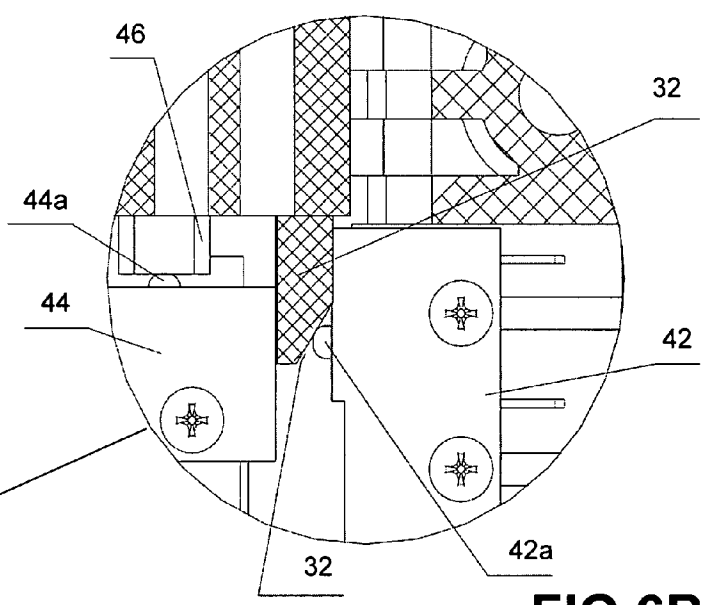
FIG. 6B is an enlarged view of a portion of the sectional view as shown in FIG. 6A, showing detailed relationship between a first pushing member, a second pushing member, and both push button switches.
Figure 6C:
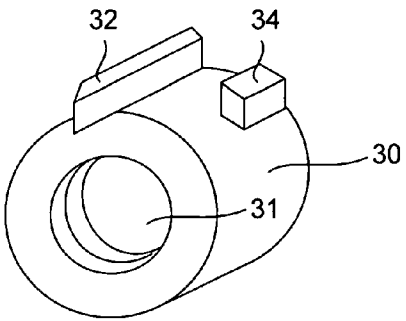
FIG. 6C is a perspective view of a first pushing member according to one embodiment of the present invention.
Figure 6A:
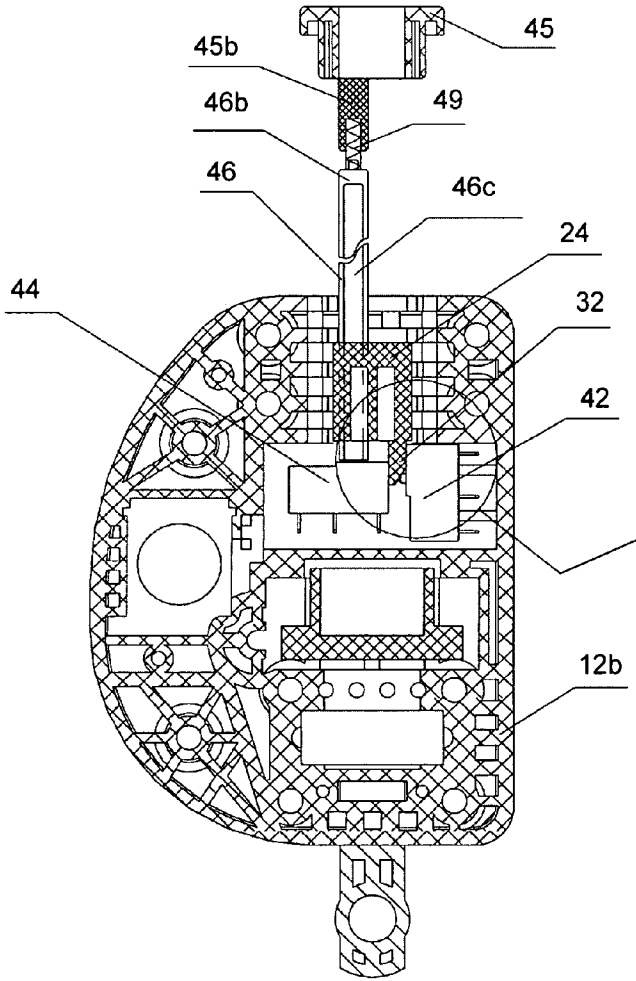
FIG. 6A schematically shows a sectional view of the actuator that is on a plane along the center of the housing and perpendicular to the A-A plane as shown in FIG. 3A according to one embodiment of the present invention.

The first push button switch 42 has a push button 42*a*, a first terminal 42*b* and a second terminal 42*c*. The second push button switch 44 has a push button 44*a*, a first terminal 44*b* and a second terminal 44*c*. The first push button switch 42 and second push button switch 44 are electrically coupled to the electric motor 18 as shown in a related circuit diagram FIG. 6D. The first push button switch 42 and second push button switch 44 are positioned apart in the housing 12, as shown in FIGS. 6A-6C.

The first push button switch 42 is an always-on switch. When the first push button 42*a* of the first push button switch 42 is not pressed, the first push button switch 42 is in an on state, where the first terminal 42*b* of the first push button switch 42 is connected to the second terminal 42*c* of the first push button switch 42. When the first push button 42*a* of the first push button switch 42 is pressed, the first push button switch 42 is in an off state, where the first terminal 42*b* of the first push button switch 42 is not electrically connected to the second terminal 42*c* of the first push button switch 42.

The second push button switch 44 is an always-off switch. When the first push button 44*a* of the second push button switch 44 is not pressed, the first push button switch 42 is in an off state, where the first terminal 44*b* of the second push button switch 44 is not connected to the second terminal 44*c* of the second push button switch 44. When the first push button 44*a* of the second push button switch 44 is pressed, the second push button switch 44 is in an on state, where the first terminal 44*b* of the second push button switch 42 is connected to the second terminal 44*c* of the second push button switch 44.

The first protrusion member 32 and second protrusion member 34 of the first pushing member 30 are configured such that when, during operation, the motion of the activation rod 28 relative to the outer tube member 24 causes the first pushing member 30 to move along a direction parallel to the central axis A. The first protrusion member 32 engages with or disengages from the first push button 42*a* of the first push button switch 42 to cause the first push button switch 42 to be in an off state or in an on state, respectively. The second protrusion member 34 engages with or disengages from the first push button 44*a* of the second push button switch 44 through a second pushing member 46 to cause the first push button switch 42 to be in an off state or in an on state, respectively.

The actuator further has a cover member 45 that is fixedly connected to the free end 24*a* of the outer tube member 24 and defines an opening 45*a* in communication with the opening of the outer tube member 24 to allow the activation rod 28 to be movable relative to the outer tube member 24.

The second pushing member 46 is slidably received in a corresponding recess 48 formed in the inner surface of the outer tube member 24. The second pushing member 46 has a first end 46*a*, an opposite, second end 46*b* and a recess 46*c* formed at least partially from the first end 46*a* to the second end 46*b*. The recess 46*c* is configured to be slidably engageable with the second protrusion member 34 of the first pushing member 30 so that the second pushing member 46 slidably engages with the second protrusion member 34 of the first pushing member 30.

The second pushing member 46 is positioned and configured such that when the first protrusion member 32 engages with the push button 42*a* of the first push button switch 42 to cause the first push button switch 42 to be in an off state, the first end 46*a* of the second pushing member 46 engages with the push button 44*a* of the second push button switch 44 to cause the second push button switch 44 to be in an on state. The second pushing member 46 is positioned and configured such that when, during operation, the motion of the activation rod 28 relative to the outer tube member 24 causes the first pushing member 30 to move along a direction parallel to the central axis A, the first protrusion member 32 disengages from the push button 42*a* of the first push button switch 42 to cause the first push button switch 42 to be in an on state. When the first pushing member 30 reaches the second end 24*b* of the outer tube 24 and the activation rod 28 is fully extended, the first end 46*a* of the second pushing member 46 disengages from the push button 44*a* of the second push button switch 44 to cause the second push button switch 44 to be in an open state.

Referring now to FIG. 2, a side view of an actuator is shown in FIG. 2A and a top view of the actuator is shown in FIG. 2B according to one embodiment of the present invention. The front end 14 and the rear end 16 are shown in the side view of the actuator 10. The outer tube member 24, the cover member 45 and the activation rod 28 are shown as assembled in an operational condition. As the reversible electric motor 18 turns in either clock-wise or counter clock-wise, the activation rod 28 moves up or down, respectively.

FIG. 3A shows a partially sectional view of an actuator showing the first push button switch 42 and the second push button switch 44 installed inside the housing 12. FIG. 3B shows a sectional view of the actuator along the A-A plane as shown in FIG. 3A. The actuator has a resilient member 49 positioned between the cover member 45 and the second end 46*b* of the second pushing member 46 for providing a force against the second end 46*b*. FIG. 3B show the relative positions of the first pushing member 30, the outer tube member 24 and the activation rod 28 when the first pushing member 30 reaches the second end 24*b* of the outer tube member 24. In this configuration, the second protrusion 34 of the first pushing member 30 pushes the second end 46*b* of the second pushing member 46 up against the resilient force of the resilient member 49 to release the second pushing member 46 from the push button 44*a* of the second push button switch 44.

Figure 4:
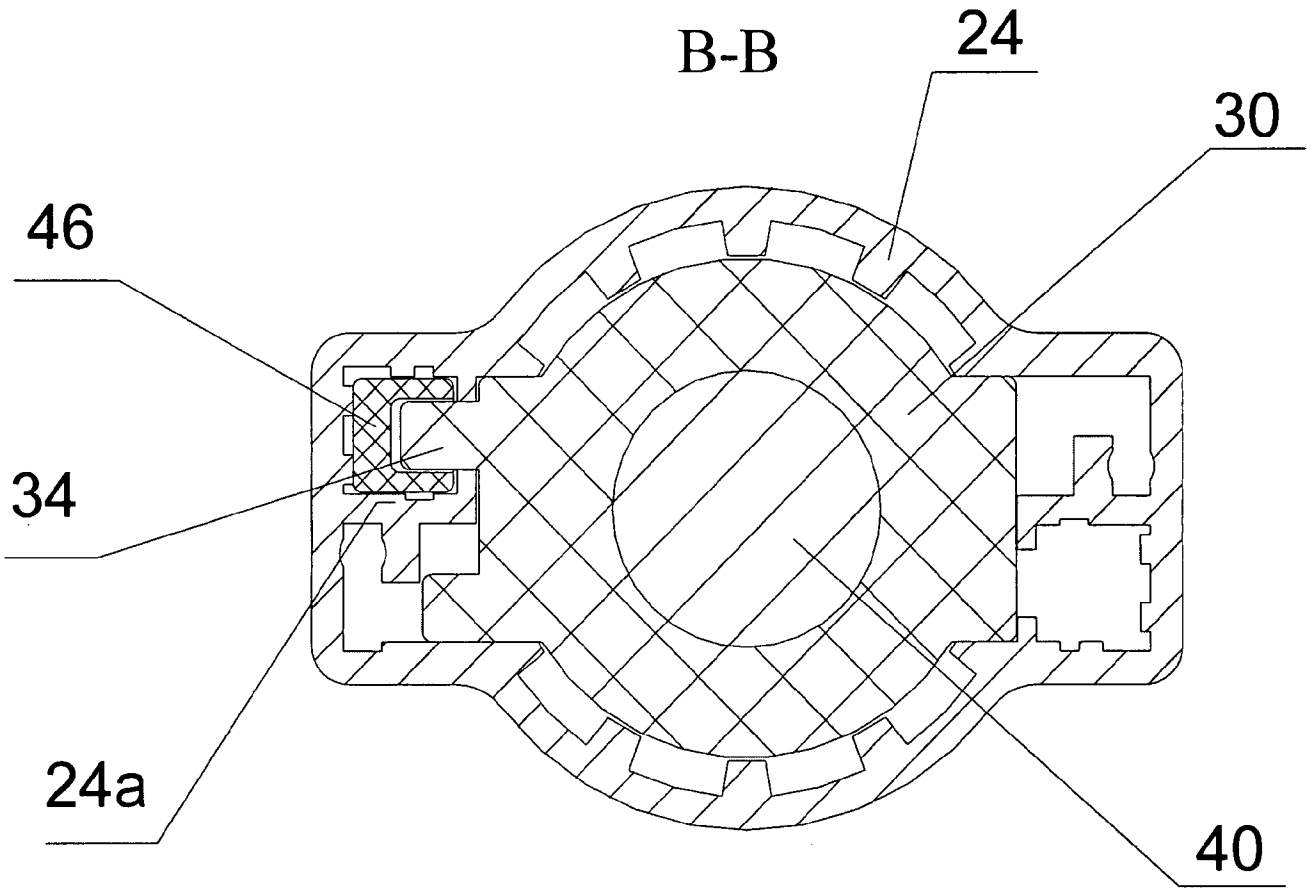
FIG. 4 schematically shows a sectional view of the actuator along the B-B plane as shown in FIG. 3B according to one embodiment of the present invention.

FIG. 4 shows a sectional view of the actuator along the B-B plane as shown in FIG. 3B. The second pushing member 46 is formed in a "U" shape in this embodiment and is installed in a recess of the outer tube member 24. The second protrusion 34 is installed along the recess of the "U" shaped second pushing member 46. When the first pushing member 30 reaches the second end 24*b* of the outer tube member 24, the second protrusion 34 pushes the second pushing member 46 up to release the second pushing member 46 from the push button 44*a* of the second push button switch 44. The first pushing member 30 is threadedly attached to the spindle 40. Due to the specific shape of the first pushing member 30, when the spindle 40 turns either direction, the first pushing member 30 will not turn with the rotation of the spindle 40. The first pushing member 30 can only slidably move inside the outer tube member 24 up or down between the two end 24*a* and 24*b* of the outer tube member 24, i.e., in a linear motion.

FIG. 5 shows a sectional view of the actuator along the A-A plane as shown in FIG. 3A, when the first pushing member 30 moves away from the second end 24*b* of the outer tube member 24. The second protrusion 34 releases the second pushing member 46. The resilient force of the resilient member 49 pushes the second pushing member 46 down so that the push button 44*a* is pressed to cause the second push button switch 44 to be in an on state.

FIG. 6A shows a sectional view of the actuator that is on a plane along the center of the housing and perpendicular to the A-A plane as shown in FIG. 3A, where the relative positions of the second pushing member 46, the second protrusion 34 of the first pushing member 30, and two push butting switches 42 and 44 are shown. The cover member 45 has a protrusion 45*b* that has a round cavity in the middle to accommodate the resilient member 49. The resilient member 49 is attached to the second end 46*b* of the second pushing member 46. The resilient force of the resilient member 49 presses the the second end 46*b* of the second pushing member 46 such that the push button 44*a* of the second push button switch 44 is pressed down, causing the second push button switch 44 to be in an on state.

FIG. 6B is an enlarged view of a portion of the sectional view as shown in FIG. 6A, showing detailed relationship between a first pushing member, a second pushing member, and both push button switches. The first protrusion 32 is moving parallel to the top surface of the first push button switch 42. When the first pushing member 30 reaches the first end 24*a* of the outer tube member 24, the first protrusion 32 moves all the way down to press the push button 42*a* of the first push button switch 42 so that the first push button switch 42 is in an off state. In the meantime, the first end 46*a* of the second pushing member 46 is also pressed on the push button 44*a* of the second push button switch 44 so that the second push button switch 44 is in an on state Referring now to FIG. 6C, a perspective view of the first pushing member 30 is shown according to one embodiment of the present invention. The first pushing member 30 has a circular shape with a round opening 31 in the middle. The inside of the first pushing member 30 is threaded to mate with the thread on the spindle 40. The first pushing member 30 is installed on the spindle so that the first pushing member 30 moves longitudinally along the axis of the spindle 40 as the spindle 40 turns. The first pushing member 30 has a first protrusion member 32, and a second protrusion member 34. The first protrusion member 32 is used to engage with a first push button switch 42. When the activation rod 28 is in a fully retracted position, the first protrusion member 32 rests on the first push button 42*a* such that the first push button switch 42 is in an off state. The second protrusion member 34 is used to engage with the second push button switch 44 through a second pushing member 46. When the activation rod 28 is in a fully extended position, the second protrusion member 34 pushes the second end 46*b* of the second pushing member 46 away from the second push button 44*a* of the second push button switch 44 such that the second push button switch 44 is in an off state.

Figure 6D:
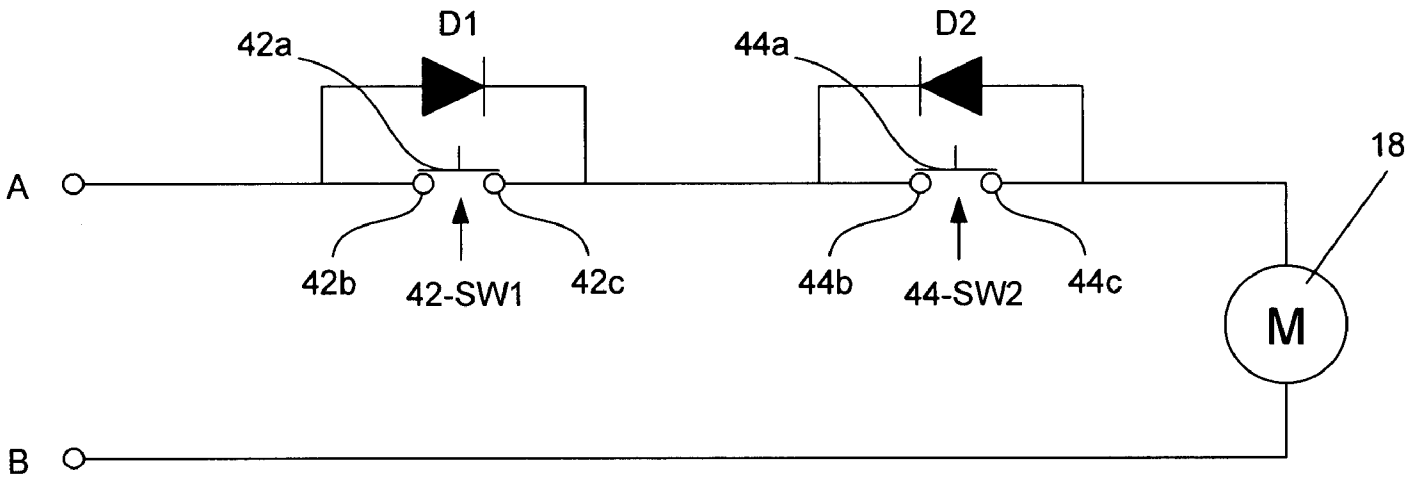
FIG. 6D is an electrical circuit diagram of a control mechanism of an actuator according to one embodiment of the present invention.

Referring now to FIG. 6D, a circuit diagram of the electrical control of the actuator is shown according to one embodiment of the present invention. The control circuit has a first input terminal A, a second input terminal B, a first push button switch 42, a first diode D1, a second push button switch 44, a second diode D2, and a reversible electric motor 18. The first input terminal A and the second input terminal B receives direct current voltage from a direct current power source.

The first push button switch 42 is an always-on switch. The first push button switch 42 has a push button 42*a*, a first terminal 42*b* and a second terminal 42*c*. When the first push button 42*a* of the first push button switch 42 is not pressed, the first push button switch 42 is in an on state, where the first terminal 42*b* of the first push button switch 42 is connected to the second terminal 42*c* of the first push button switch 42. When the first push button 42*a* of the first push button switch 42 is pressed, the first push button switch 42 is in an off state, where the first terminal 42*b* of the first push button switch 42 is not connected to the second terminal 42*c* of the first push button switch 42.

The second push button switch 44 is an always-off switch. The second push button switch 44 has a push button 44*a*, a first terminal 44*b* and a second terminal 44*c*. When the first push button 44*a* of the second push button switch 44 is not pressed, the first push button switch 42 is in an off state, where the first terminal 44*b* of the second push button switch 44 is not connected to the second terminal 44*c* of the second push button switch 44. When the first push button 44*a* of the second push button switch 44 is pressed, the second push button switch 44 is in an on state, where the first terminal 44*b* of the second push button switch 42 is connected to the second terminal 44*c* of the second push button switch 44.

The first diode D1 provides a bypass when the first push button switch 42 is in an off state so that the direct current passes through the first input terminal A, the first diode D1, the first terminal 44*b* to the second terminal 44*c* of the closed second push button switch 44, the reversible electric motor 18 to the second input terminal B. The second diode D2 provides a bypass when the second push button switch 44 is in an off state so that the direct current passes through the second input terminal B, the reversible electric motor 18, the second diode D2, the second terminal 44*c* to the first terminal 44*b* of the closed first push button switch 42, to the first input terminal A in a reversed direction.

Figure 6E:
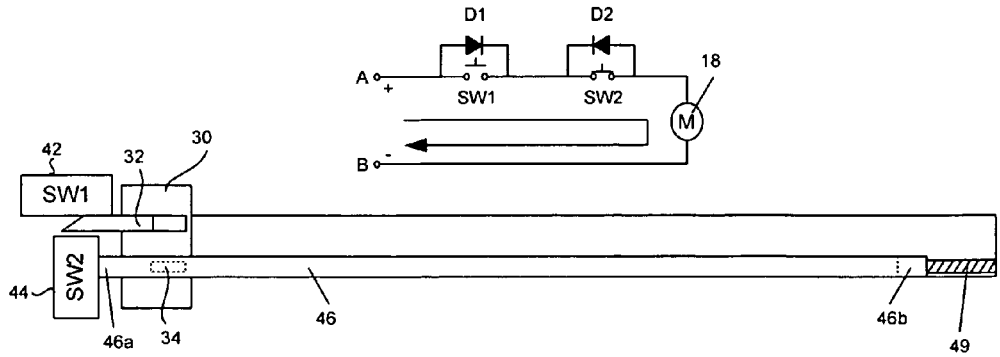
FIG. 6E illustrates the position of the first pushing member of the actuator when the actuator is in a fully retracted position, and its corresponding electrical circuit diagram of the control mechanism of the actuator, according to one embodiment of the present invention.

FIG. 6E illustrates that the first pushing member 30 rests in a first position where the activation rod 28 is in a fully retracted position with its corresponding electrical circuit. When the activation rod 28 is in fully retracted position, the first protrusion member 32 of the first pushing member 30 rests on the surface of the first push button switch 42 and the first protrusion member 32 presses the first push button 42*a* down such that the first push button switch 42 is in an off state as illustrated in the circuit diagram in FIG. 6E. At the resilient force of the resilient member 49, the first end 46*a* of the second pushing member 46 rests on the surface of the second push button switch 44, such that the second push button switch 44 is in an on state. At this position, the use of the first diode D1 ascertains that the reversible electric motor 18 can only turn in one direction to move the first pushing member 30 to the right.

Figure 6F:
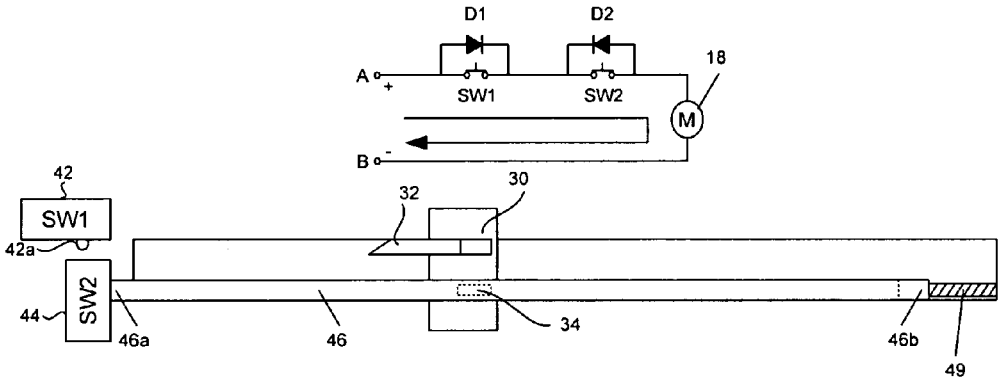
FIG. 6F illustrates the position of the first pushing member of the actuator when the actuator is in a partially extended position, and its corresponding electrical circuit diagram of the control mechanism of the actuator, according to one embodiment of the present invention.

When the user operates a control of the actuator to change position, a positive direct current voltage is applied to the first input terminal A, and a negative direct current voltage is applied to the second input terminal B. The direct current passes through a first diode D1 and the second push button switch 44 in on state to the reversible electric motor 18 in a first direction so that spindle 40 turns in a first direction and the first pushing member 30 moves from the left to the right to extend the activation rod 28. When the first pushing member 30 moves far enough to the right, the first protrusion member 32 of the first pushing member 30 moves away from the surface of the first push button switch 42 such that the first push button switch 42 is in a an on state, as illustrated in FIG. 6F.

When the user release the control of the actuator by cutting off the electric current, the actuator will remain in that position until electric current is applied. At this position, since the first push button switch 42 and the second push button switch 44 are both in an on states, the reversible electric motor 18 may turn on either direction depending on the polarity of the direct current voltage applied to the first terminal A and second terminal B. Therefore the first pushing member 30 can be moved in both directions. Here, the first diode D1 and second diode D2 are redundant.

Figure 6G:
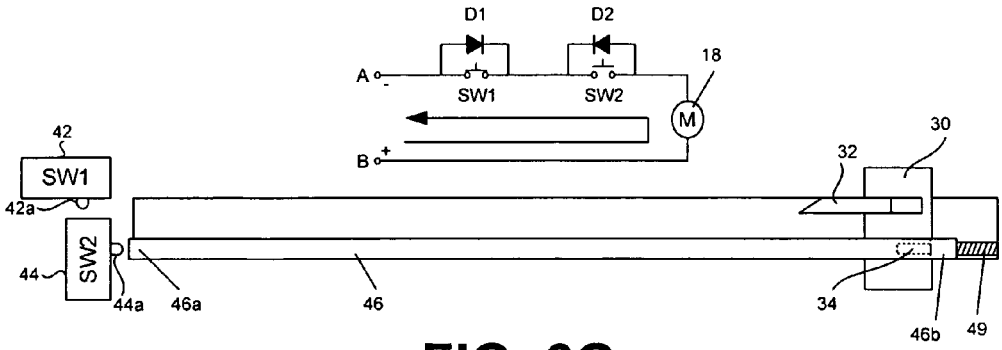
FIG. 6G schematically illustrates the position of the first pushing member of the actuator when the actuator is in a fully extended position, and its corresponding electrical circuit diagram of the control mechanism of the actuator, according to one embodiment of the present invention.
Figure 7:
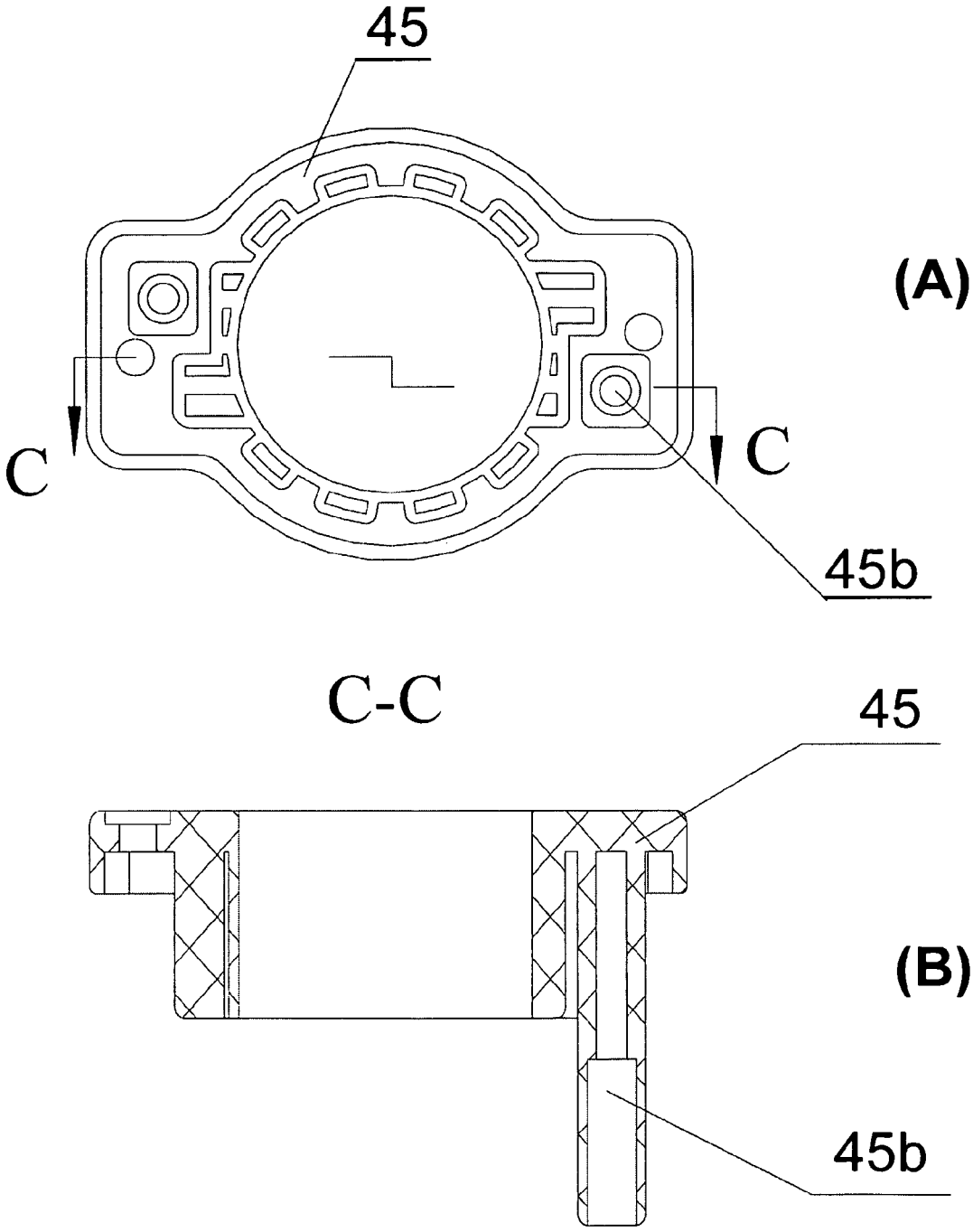
FIG. 7A schematically shows a bottom view of a cover member according to one embodiment of the present invention.
FIG. 7B schematically shows a sectional view of the cover member along the C-C plane as shown in FIG. 7A, according to one embodiment of the present invention.
Figure 8:
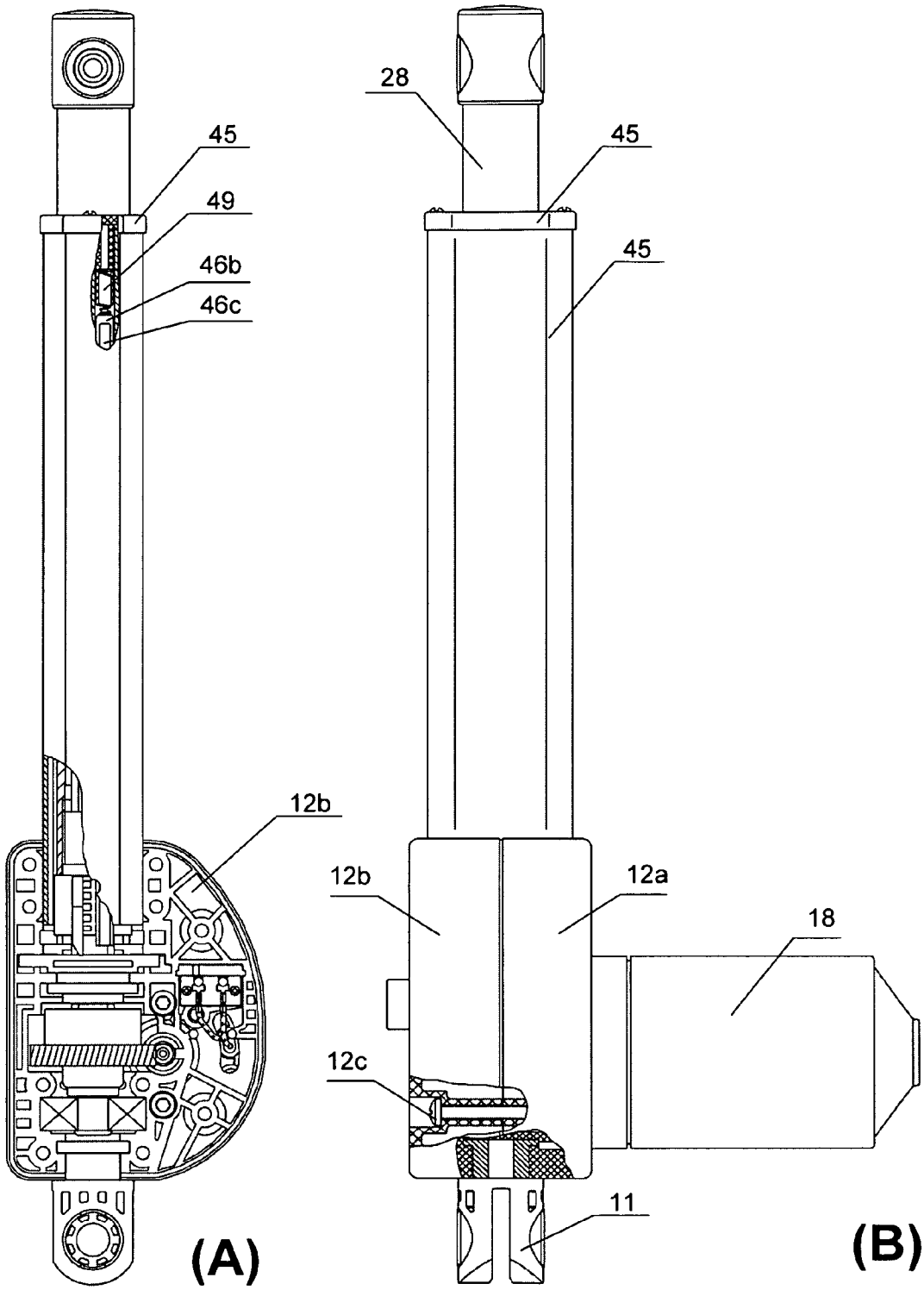
FIG. 8A schematically shows a partially exposed view of components of the control mechanism of an actuator according to one embodiment of the present invention.
FIG. 8B schematically shows a partially exposed view of actuator housing parts fastened by a plurality of screws to form the actuator housing according to one embodiment of the present invention.

Referring now to FIG. 6G, the first pushing member 30 is shown to rest in a second position where the activation rod 28 is in fully extended position with its corresponding electrical circuit. When the activation rod 28 is in fully extended position, the second protrusion member 34 of the first pushing member 30 reaches to the second end 46*b* of the second pushing member 46 and push the second pushing member 46 to the right against the resilient force of the resilient member 49. This movement releases the second push button switch 44 so that the second push button switch 44 is in an off state, as shown in the circuit diagram of FIG. 6G. At this position, the use of the second diode D2 ascertains that the reversible electric motor 18 can only turn in one direction to move the first pushing member 30 to the left. The resilient member 49 can be a spring.

FIG. 7A shows a bottom view of a cover member 45 according to one embodiment of the present invention. FIG. 7B shows a sectional view of the cover member along the C-C plane as shown in FIG. 7A. The cover member 45 has a protrusion 45*b* with a round opening to accommodate the resilient member 49. The cover 45 is fitted on the second end 24*b* of the outer tube member 24.

FIG. 8A shows a partially exposed view of components of the control mechanism of an actuator. FIG. 8A further demonstrates the spatial relationship between the cover member 45, the resilient member 49, the second end 46*b* of the second pushing member 46. FIG. 8B shows a partially exposed view of that the first housing part 12*a*, and the second housing part 12*b* are fastened by a plurality of housing screws 12*c* to form the actuator housing 12.

Figure 9:
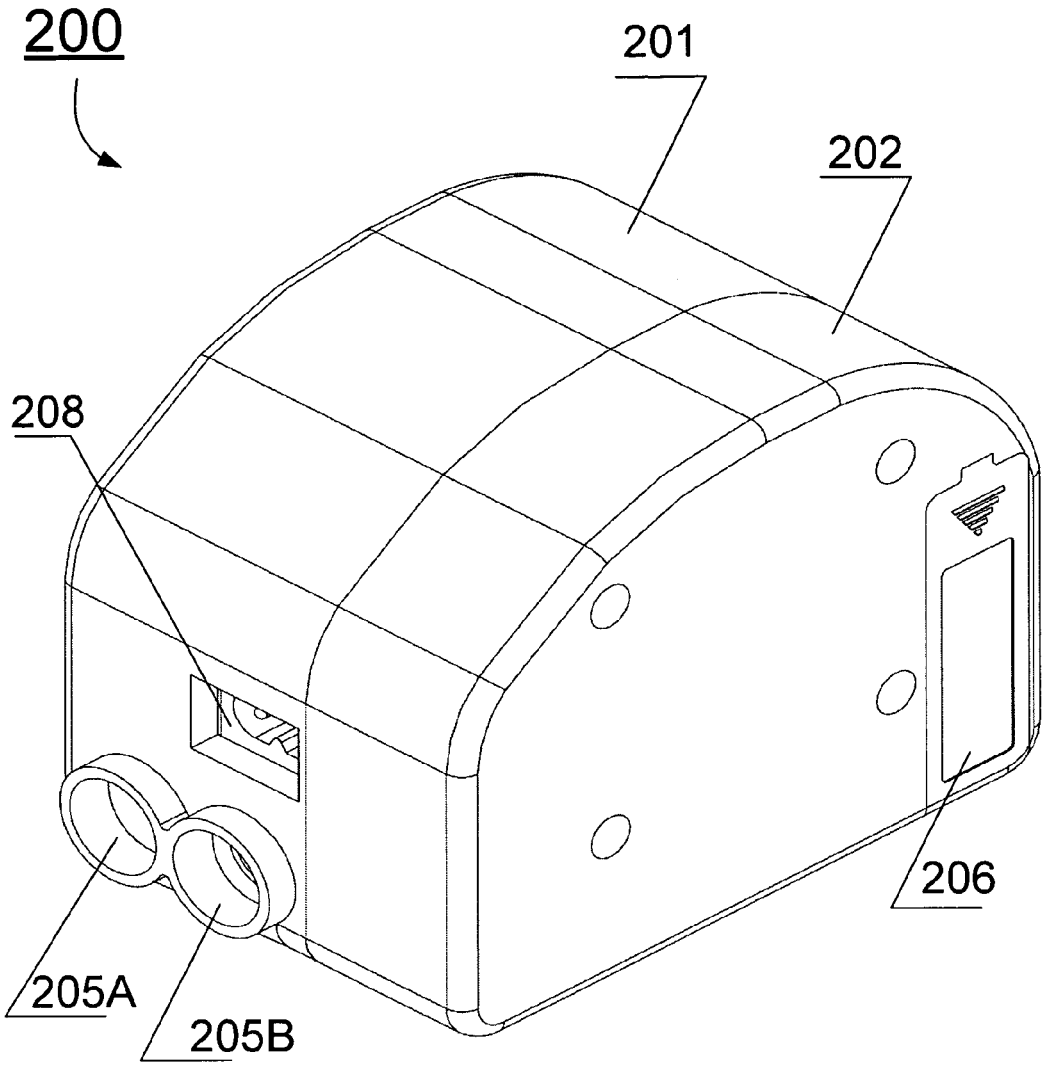
FIG. 9 schematically shows a perspective view of a power module for an actuator according to one embodiment of the present invention.
Figure 10:
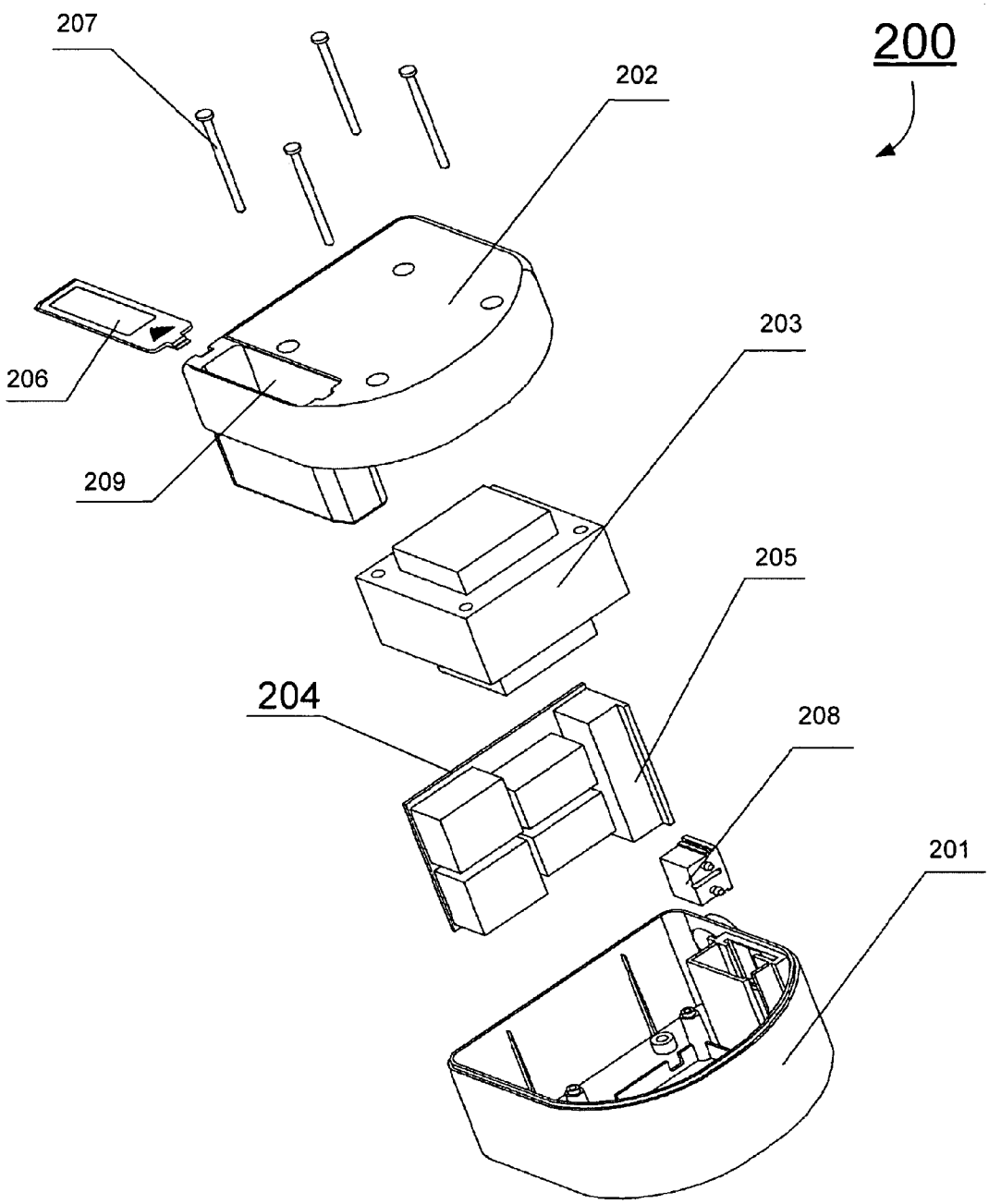
FIG. 10 schematically shows a perspective and exploded view of a power module for an actuator according to one embodiment of the present invention.

Referring now to FIGS. 9 and 10, a perspective view of a power module 200 for an actuator 10 and a perspective and exploded view of the power module 200 are shown for an actuator according to one embodiment of the present invention. The power module 200 also has a transformer 203, an electronic printed circuit board 204 that includes electronic components for providing power supply to the actuator 10, a motor power connector 205A, and a motor control connector 205B. The transformer 203 and the electronic printed circuit board 204 are used to provide the reversible electric motor 18 DC power supply and control signals.

The power module 200 has a first housing member 201, and a second housing member 202. The first housing member 201 and the second housing member 202 are fastened by a plurality of screws. FIG. 9 is a perspective view of a fully assembled power module 200.

The first housing part 201 has an AC power connector 208 mounted from the inside of the first housing member 201. The second housing member 202 has a battery compartment 209 to store a battery. The battery compartment 209 has a battery compartment cover 206 to cover the battery compartment 209 when the power module 200 is fully assembled.

Figure 11:
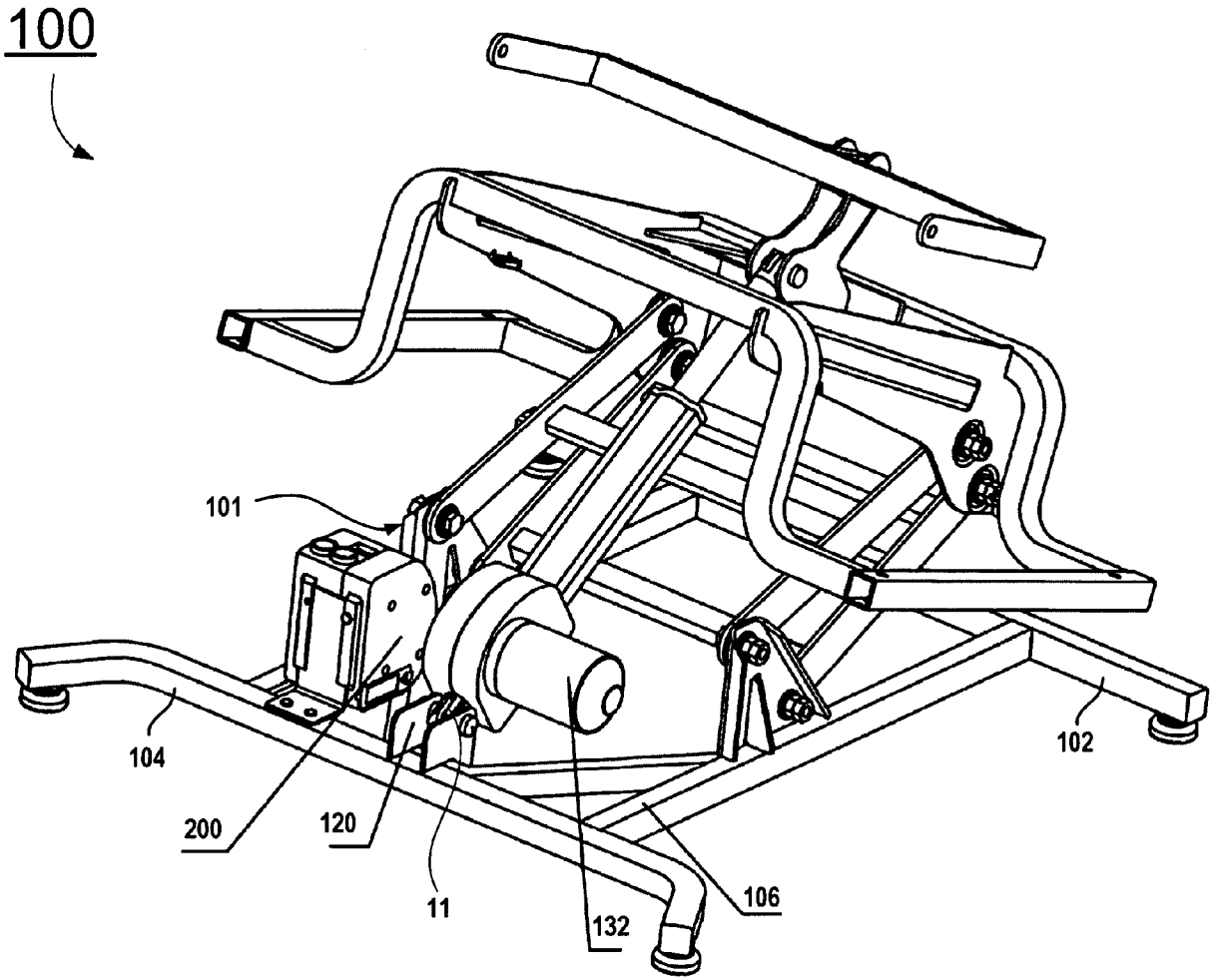
FIG. 11 schematically shows an actuator used in a support frame according to one embodiment of the present invention.
Figure 12A:
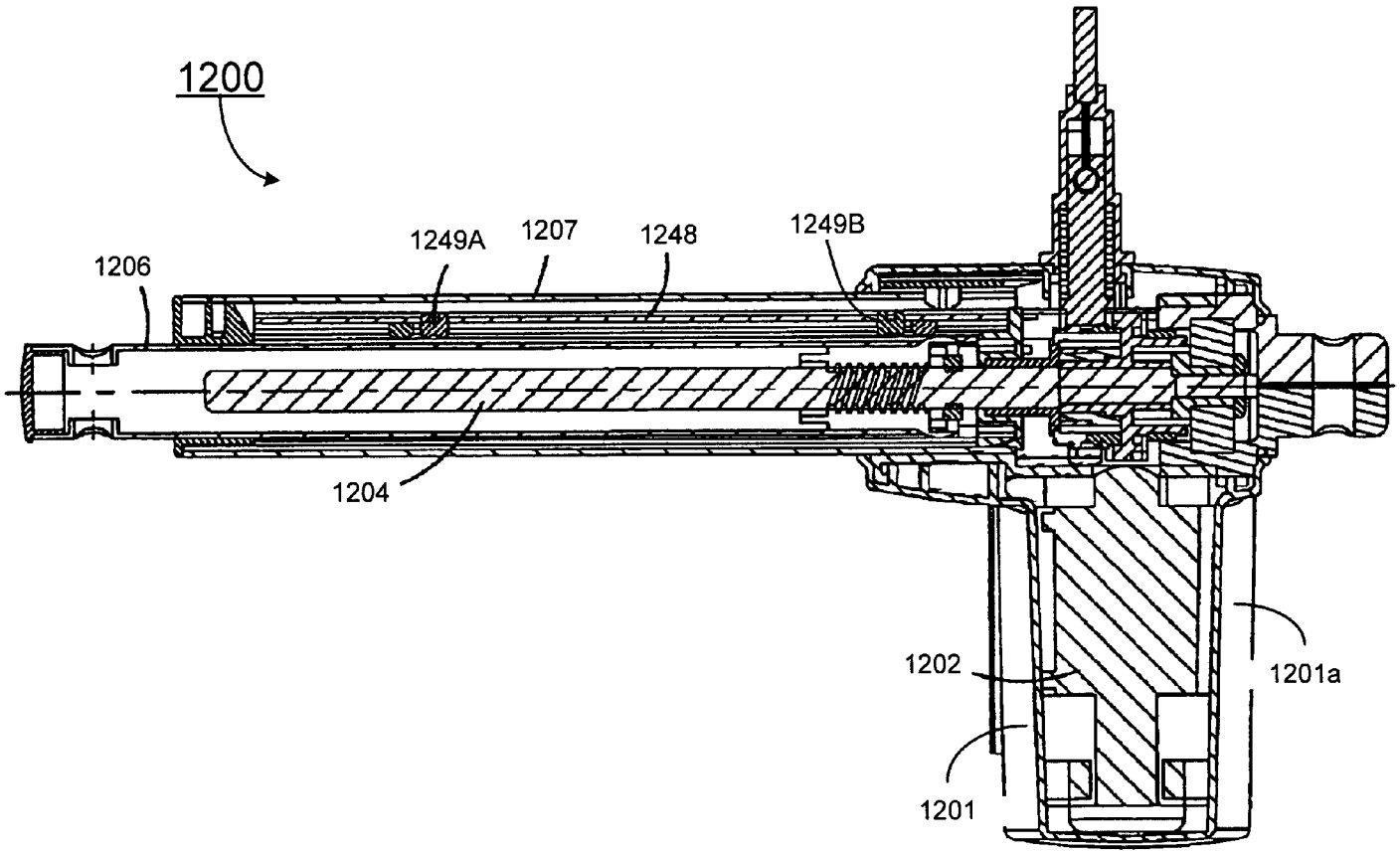
FIG. 12A (RELATED ART)
FIG. 12A schematically shows a sectional view of a conventional actuator.
Figure 12B:
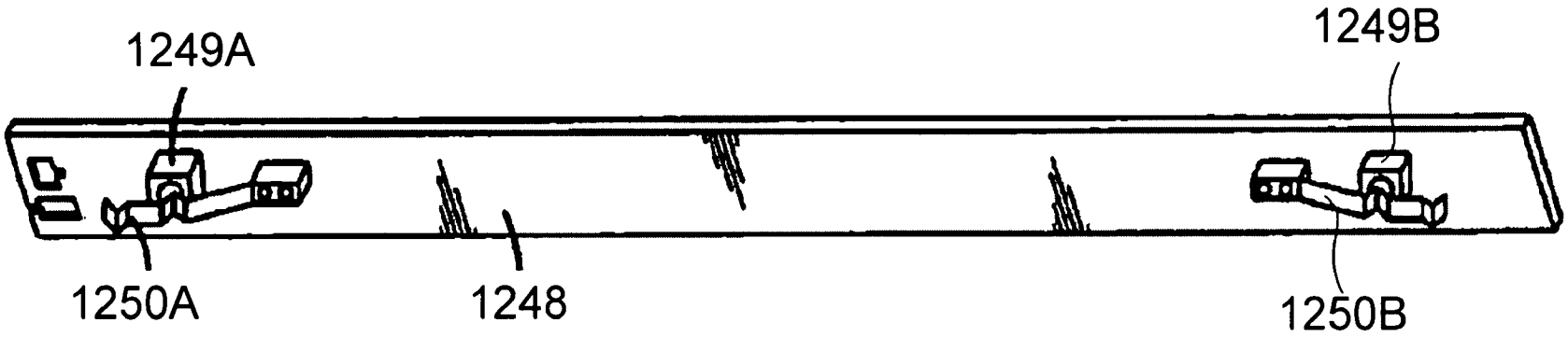
FIG. 12B (RELATED ART)
FIG. 12B schematically shows a perspective view of an actuator control mechanism of the conventional actuator shown in FIG. 12A.

FIG. 11 shows an actuator 10 and a power module 200 are used in a support frame 100 for use in a lift chair. In one embodiment, the support frame 100 has a base frame 101 having longitudinally extending front and rear frame base rails 102, 104, a first longitudinally extending side frame base rail 106 connected to the front and rear frame base rails 102, 104 and a second longitudinally extending side frame base rail 108 connected to the front and rear frame base rails 102, 104, respectively, the first and second side frame base rails and the front and rear frame base rails being co-planar for supporting the lift chair on a surface such as a floor, an actuator 132 and a support member 120 configured to engage with the actuator 132 through, e.g., an engagement member 11, and mounted to the rear frame base rail 104. The actuator 132 has the structure and functionality as disclosed above, which can be utilized to power a lift chair that has, among other things, improved safety and uniform motion.

The DC power supply may be a battery, a transformer that transforms an AC current to a DC current, or both.

A support frame utilizing such an actuator for use in a lift chair can be constructed by people who skilled in the art. A lift chair utilizing such a support frame can be constructed by people who skilled in the art.

While there has been shown several and alternate embodiments of the present invention, it is to be understood that certain changes can be made as would be known to one skilled in the art without departing from the underlying scope of the invention as is discussed and set forth in the specification given above and in the claims given below. Furthermore, the embodiments described above are only intended to illustrate the principles of the present invention and are not intended to limit the scope of the invention to the disclosed elements.

What is claimed is:

1. An actuator that is usable in a support frame for use in a lift chair, comprising:

a. a housing having a first housing part and a second housing part, the housing defining a front end and a rear end;

b. the first housing part configured to define an opening on a side and provide a journal bearing;

c. a reversible electric motor positioned in the first housing part and received by the opening;

d. a worm that extends into the journal bearing and connects with a worm wheel, wherein the worm is driven by the electric reversible motor in operation;

e. an outer tube member that extends through an opening defined in the front end of the housing to a free end spaced forwardly of the front end of the housing and has a central axis;

f. an activation rod that extends from within the housing through and beyond the free end of the outer tube member to an opposite, second end providing a first fitting for connection to a first pushing member, the activation rod being telescopically movable relative to the outer tube member;

g. the first pushing member movable with the activation rod and having a threaded opening, a first protrusion member and a second protrusion member spaced apart from the first protrusion member;

h. a spindle bearing supported by a corresponding spindle bearing recess formed in the housing proximate to the rear end of the housing;

i. a spindle that is mounted in the spindle bearing and extends into the threaded opening of the activation rod for connection to the activation rod, rotation of the worm and the worm wheel by the electric reversible motor causing the spindle to rotate and telescopically move the activation rod relative to the outer tube member; and j. a first push button switch with a push button and a second push button switch with a push button, the first push button switch and second push button switch electrically coupled to the electric reversible motor and positioned apart in the housing;

wherein the first push button switch and second push button switch are positioned in the housing and the first protrusion member and second protrusion member of the first pushing member are configured such that when, during operation, the motion of the activation rod relative to the outer tube member causes the first pushing member to move along a direction parallel to the central axis, the first protrusion member engages with or disengages from the push button of the first push button switch to cause the first push button switch to be in a first state or in a second state that is different from the first state, respectively.

2. The actuator of claim 1, further comprising a cover member fixedly connected to the free end of the outer tube member and defining an opening in communication with the opening of the outer tube member to allow the activation rod to be movable relative to the outer tube member.

3. The actuator of claim 2, further comprising a resilient member positioned between the cover member and the second end of the second pushing member for providing a force against the second end.

4. The actuator of claim 2, further comprising a second pushing member slidably received in a corresponding recess formed in the inner surface of the outer tube member, the second pushing member having a first end, an opposite, second end and a recess formed at least partially from the first end to the second end, wherein the recess is configured to be slidably engageable with the second protrusion member of the first pushing member so that the second pushing member slidably engages with the second protrusion member of the first pushing member.

5. The actuator of claim 4, wherein one of the first push button switch and the second push button switch is an always-on push button switch and the other is an always-off push button switch.

6. The actuator of claim 5, wherein the first push button switch is an always-on push button switch, and the second push button switch is an always-off push button switch.

7. The actuator of claim 6, wherein the second pushing member is positioned and configured such that when the first protrusion member engages with the push button of the first push button switch to cause the first push button switch to be in an off state, the first end of the second pushing member engages with the push button of the second push button switch to cause the second push button switch to be in an on state.

8. The actuator of claim 7, wherein the second pushing member is positioned and configured such that when, during operation, the motion of the activation rod relative to the outer tube member causes the first pushing member to move along with a direction parallel to the central axis, the first protrusion member disengages from the push button of the first push button switch to cause the first push button switch to be in an on state, the first end of the second pushing member disengages from the push button of the second push button switch to cause the second push button switch to be in an off state.

9. The actuator of claim 8, wherein said second pushing member is positioned and configured such that when, during operation, when the first pushing member reaches the second end of the outer tube and the activation rod is fully extended, said second protrusion member disengages from said push button of said second push button switch through the second pushing member to cause said second push button switch to be in an off state.

10. The actuator of claim 9, wherein when the first push button switch is in an on state, the second push button switch is also in an on state if the first end of the second pushing member still engages with the push button of the second push button switch to cause the second push button switch to be in an off state.

11. The actuator of claim 6, wherein the first state is an off state, and the second state is an on state.

12. The actuator of claim 11, further comprising a first diode electrically coupled to the first push button switch in parallel and having an anode and a cathode, and a second diode electrically coupled to the second push button switch in parallel and having an anode and a cathode, wherein the first diode and the second diode are electrically coupled in a configuration such that the cathode of the first diode is electrically coupled to the cathode of the second diode.

13. An actuator that is usable in a support frame for use in a lift chair, comprising:

a. a housing;

b. a reversible electric motor positioned in the housing;

c. a worm that connects with a worm wheel, wherein the worm is driven by the electric reversible motor in operation;

d. an outer tube member that extends through an opening defined in a front end of the housing and has a central axis;

e. an activation rod configured to be telescopically movable relative to the outer tube member;

f. a first pushing member movable with the activation rod and having a threaded opening, a first protrusion member and a second protrusion member spaced apart from the first protrusion member;

g. a first push button switch with a push button; and h. a second push button switch with a push button, the first push button switch and second push button switch electrically coupled to the electric reversible motor and positioned apart in the housing.

14. The actuator of claim 13, wherein the first push button switch and second push button switch are positioned in the housing and the first protrusion member and second protrusion member of the first pushing member are configured such that when, during operation, the motion of the activation rod relative to the outer tube member causes the first pushing member to move along a direction parallel to the central axis, the first protrusion member engages with or disengages from the push button of the first push button switch to cause the first push button switch to be in a first state or in a second state that is different from the first state, respectively.

15. The actuator of claim 14, further comprising a cover member fixedly connected to the free end of the outer tube member and defining an opening to allow the activation rod to be movable relative to the outer tube member.

16. The actuator of claim 15, further comprising a second pushing member slidably received in a corresponding recess formed in the inner surface of the outer tube member, the second pushing member having a first end, an opposite, second end and a recess formed at least partially from the first end to the second end, wherein the recess is configured to be slidably engageable with the second protrusion member of the first pushing member so that the second pushing member slidably engages with the second protrusion member of the first pushing member.

17. The actuator of claim 16, further comprising a resilient member positioned between the cover member and the second end of the second pushing member for providing a force against the second end.

18. The actuator of claim 16, wherein one of the first push button switch and the second push button switch is an always-off push button switch and the other is an always-on push button switch.

19. The actuator of claim 18, further comprising a first diode electrically coupled to the first push button switch in parallel and having an anode and a cathode, and a second diode electrically coupled to the second push button switch in parallel and having an anode and a cathode, wherein the first diode and the second diode are electrically coupled in a configuration such that the cathode of the first diode is electrically coupled to the cathode of the second diode and the anode of the second diode is electrically coupled to a first terminal of the motor.

20. The actuator of claim 19, further comprising a DC power supply having a first output terminal and a second output terminal, wherein the first output terminal of the DC power supply is electrically coupled to the anode of the first diode and the second output terminal of the DC power supply is electrically coupled to electrically coupled to a second terminal of the motor.

21. The actuator of claim 20, wherein the DC power supply comprises a battery.

22. The actuator of claim 21, wherein the DC power supply comprises a transformer that transforms an AC current to a DC current.

23. The actuator of claim 18, wherein the first push button switch is an always-on push button switch, and the second push button switch is an always-off push button switch.

24. The actuator of claim 23, wherein the second pushing member is positioned and configured such that when the first protrusion member engages with the push button of the first push button switch to cause the first push button switch to be in an off state, the first end of the second pushing member engages with the push button of the second push button switch to cause the second push button switch to be in an on state.

25. The actuator of claim 24, wherein the second pushing member is positioned and configured such that when, during operation, the motion of the activation rod relative to the outer tube member causes the first pushing member to move along a direction parallel to the central axis, the first protrusion member disengages from the push button of the first push button switch to cause the first push button switch to be in an on state, the first end of the second pushing member disengages from the push button of the second push button switch to cause the second push button switch to be in an off state.

26. The actuator of claim 25, wherein when the first push button switch is in an on state, the second push button switch is also in an on state if the first end of the second pushing member still engages with the push button of the second push button switch to cause the second push button switch to be in an off state.

27. The actuator of claim 23, wherein the first state is an off state, and the second state is an on state.

28. A support frame for use in a lift chair, comprising:

a. a base frame having longitudinally extending front and rear frame base rails;

b. a first longitudinally extending side frame base rail connected to the front and rear frame base rails and a second longitudinally extending side frame base rail connected to the front and rear frame base rails respectively, the first and second side frame base rails and the front and rear frame base rails being co-planar for supporting the lift chair on a surface;

c. an actuator, the actuator comprising:

(i). a housing;

(ii). a reversible electric motor positioned in the housing;

(iii). a worm that connects with a worm wheel, wherein the worm is driven by the electric reversible motor in operation;

(iv). an outer tube member that extends through an opening defined in a front end of the housing and has a central axis;

(v). an activation rod configured to be telescopically movable relative to the outer tube member;

(vi) a first pushing member movable with the activation rod and having a threaded opening, a first protrusion member and a second protrusion member spaced apart from the first protrusion member; and (vii). a first push button switch with a push button; and a second push button switch with a push button, the first push button switch and second push button switch electrically coupled to the electric reversible motor and positioned apart in the housing; and d. a support member configured to engage with the actuator and mounted to the rear frame base rail.

29. The support frame of claim 28, wherein the first push button switch and second push button switch are positioned in the housing and the first protrusion member and second protrusion member of the first pushing member are configured such that when, during operation, the motion of the activation rod relative to the outer tube member causes the first pushing member to move along a direction parallel to the central axis, the first protrusion member engages with or disengages from the push button of the first push button switch to cause the first push button switch to be in a first state or in a second state that is different from the first state, respectively.

30. The support frame of claim 29, further comprising a cover member fixedly connected to the free end of the outer tube member and defining an opening to allow the activation rod to be movable relative to the outer tube member.

31. The support frame of claim 30, further comprising a second pushing member slidably received in a corresponding recess formed in the inner surface of the outer tube member, the second pushing member having a first end, an opposite, second end and a recess formed at least partially from the first end to the second end, wherein the recess is configured to be slidably engageable with the second protrusion member of the first pushing member so that the second pushing member slidably engages with the second protrusion member of the first pushing member.

32. The support frame of claim 31, wherein one of the first push button switch and the second push button switch is an always-on push button switch and the other is an always-off push button switch.

33. The support frame of claim 32, wherein the first push button switch is an always-on push button switch, and the second push button switch is an always-off push button switch.

34. The support frame of claim 33, wherein the second pushing member is positioned and configured such that when the first protrusion member engages with the push button of the first push button switch to cause the first push button switch to be in an off state, the first end of the second pushing member engages with the push button of the second push button switch to cause the second push button switch to be in an on state.

35. The support frame of claim 34, wherein the second pushing member is positioned and configured such that when, during operation, the motion of the activation rod relative to the outer tube member causes the first pushing member to move along a direction parallel to the central axis, the first protrusion member disengages from the push button of the first push button switch to cause the first push button switch to be in an on state, the first end of the second pushing member disengages from the push button of the second push button switch to cause the second push button switch to be in an off state.

36. The support frame of claim 35, wherein when the first push button switch is in an on state, the second push button switch is also in an on state if the first end of the second pushing member still engages with the push button of the second push button switch to cause the second push button switch to be in an off state.

37. The support frame of claim 33, wherein the first state is an off state, and the second state is an on state.

38. The support frame of claim 28, further comprising a first diode electrically coupled to the first push button switch in parallel and having an anode and a cathode, and a second diode electrically coupled to the second push button switch in parallel and having an anode and a cathode, wherein the first diode and the second diode are electrically coupled in a configuration such that the cathode of the first diode is electrically coupled to the cathode of the second diode and the anode of the second diode is electrically coupled to a first terminal of the motor.

39. The support frame of claim 38, further comprising a DC power supply having a first output terminal and a second output terminal, wherein the first output terminal of the DC power supply is electrically coupled to the anode of the first diode and the second output terminal of the DC power supply is electrically coupled to electrically coupled to a second terminal of the motor.

40. The support frame of claim 28, wherein the actuator further comprises an engagement member that is fixedly connected with the housing and protruding away from the rear end to engage with the support member.

41. A lift chair comprising a support frame of claim 28.

42. An actuator that is usable in a support frame for use in a lift chair, comprising:

a. a reversible electric motor having a first terminal and a second terminal;

b. a first push button switch having a push button, a first terminal and a second terminal;

c. a second push button switch having a push button, a first terminal and a second terminal, wherein the first terminal of the second push button switch is electrically coupled to the second terminal of the first push button switch;

d. a first diode having an anode and a cathode; and e. a second diode having an anode and a cathode, wherein the first diode is electrically coupled to the first push button switch in parallel with the anode of the first diode electrically coupled to the first terminal of the first push button switch and the cathode of the first diode electrically coupled to the second terminal of the first push button switch, respectively;

wherein the second diode is electrically coupled to the-second push button switch in parallel with the cathode of the second diode electrically coupled to the first terminal of the second push button switch and the anode of the second diode electrically coupled to the second terminal of the second push button switch respectively;

wherein the anode of the second diode and the second terminal of the second push button switch are electrically coupled to the first terminal of the electric reversible motor;

wherein the anode of the first diode and the first terminal of the first push button switch are electrically coupled to a first power terminal; and wherein the first terminal of the electric reversible motor is electrically coupled to a second power terminal.

43. The actuator of claim 42, further comprising a DC power supply having a first output terminal and a second output terminal, wherein the first output terminal of the DC power supply is electrically coupled to the first power terminal and the second output terminal of the DC power supply is electrically coupled to the second power terminal.

44. The actuator of claim 43, wherein when the first push button switch is in an off state and the second push button switch is in an on state, the motor can only rotate in a first direction.

45. The actuator of claim 44, wherein when the first push button switch is in an on state and the second push button switch is in an off state, the motor can only rotate in a second direction that is opposite to the first direction.

46. The actuator of claim 45, wherein when the first push button switch is in an on state and the second push button switch is in an on state, the motor can rotate in either of the second direction and the first direction.

47. A support frame for use in a lift chair comprising an actuator of claim 46.

48. A lift chair comprising a support frame of claim 47.

* * * * *